US005421800A

United States Patent [19]

Mullen

[11] Patent Number: 5,421,800

[45] Date of Patent: Jun. 6, 1995

[54] FREE-WEIGHT, PUSHUP, AND UPPER BODY EXERCISE DEVICE

[76] Inventor: Karl I. Mullen, 7700 SW. Canyon Dr., Portland, Oreg. 97225

[21] Appl. No.: 833,319

[22] Filed: Feb. 10, 1992

Related U.S. Application Data

[60] Continuation-in-part of Ser. No. 494,144, Mar. 14, 1990, abandoned, which is a continuation-in-part of Ser. No. 327,706, May 10, 1989, abandoned, which is a division of Ser. No. 117,999, Nov. 6, 1987, Pat. No. 4,832,334.

[51] Int. Cl.[6] ..... A63B 21/05

[52] U.S. Cl. ..... 482/121; 482/130; 482/141

[58] Field of Search ..... 482/121—130, 482/141

[56] References Cited

U.S. PATENT DOCUMENTS

| | | | |
|---|---|---|---|
| 1,509,750 | 9/1924 | Campbell | 482/128 X |
| 1,548,849 | 8/1925 | Boden | 482/128 |
| 2,494,094 | 1/1950 | Horstman | 482/128 |
| 3,228,392 | 1/1966 | Speyer | 482/122 |
| 3,992,004 | 11/1976 | Furon et al. | 482/130 X |
| 4,709,923 | 12/1987 | Gibson | 482/130 X |
| 4,718,664 | 1/1988 | Carpenter | 482/138 X |
| 4,775,148 | 10/1988 | McLaughlin | 482/124 |

*Primary Examiner*—Richard J. Apley
*Assistant Examiner*—John Mucahy

[57] ABSTRACT

A portable device that assists exercisers who do push-ups or use free weights through the difficult portion of the exercise motion, so as to allow exercisers to obtain better results more efficiently: Upper and lower surfaces, a force-generating device and a force-transferring device cooperate to transfer a selected amount of upward force to an exerciser's body (in the case of push-ups) or a barbell (in the case of free-weight exercise) through a predetermined portion of the exercise motion. Thus, this device allows an exerciser to combine the benefits of variable-resistance exercise machines with the benefits of pushups and free-weight exercise. Also, exercisers not strong enough to do pushups will be able to do them with this device, other exercisers will be able to obtain better results doing pushups, and all exercisers will be able to perform back exercises with the same device, and then fold up the device into a compact briefcase size and shape for travel or storage.

12 Claims, 9 Drawing Sheets

FREE-WEIGHT, PUSHUP, AND UPPER BODY EXERCISE DEVICE

CROSS REFERENCE TO RELATED APPLICATIONS

This is a continuation in part of Ser. No. 07/494,144 filed Mar. 14, 1990, abandoned, which is a continuation in part of Ser. No. 07/327,706 filed May 10, 1989, abandoned and which is a divisional of Ser. No. 07/117,999 filed Nov. 6, 1987 (now U.S. Pat. No. 4,832,334).

BACKGROUND

1. Field of Invention

This invention relates to free-weight exercise, pushups, and portable exercise devices.

2. Description of Prior Art

This invention allows persons (hereinafter, "exercisers") who exercise by performing pushups, reverse tricep pushups,and other exercises in which the exercisers lift their own body weight (hereinafter, "calisthenics") or by lifting barbells and other weights which are not connected to chains, wires, pulleys or machines (hereinafter, "free-weights") to obtain better and more complete muscular development more quickly and efficiently.

This invention also helps exercisers who are unable to do any or more than a few pushups to do pushups and to improve their ability to do pushups, while allowing exercisers to use the same device to exercise their back and arm muscles by doing lat pulls/rowing.

Thus, this invention will aid both exercisers who use free-weights (hereinafter, "weightlifters") and exercisers who do calisthenics or otherwise want to exercise without weights and without complex or cumbersome exercise machines. Several embodiments of this invention are also portable, relatively inexpensive, and relatively simple and easy to manufacture, use, and maintain.

One drawback of performing calisthenics or using free-weights is that the downward force remains constant throughout the entire exercise stroke. Because the angle, force and torque of the muscles being worked varies during the exercise stroke, there is generally a portion of the exercise stroke (the "weakpoint") through which the muscles are not able to lift as much weight as during the remaining portion of the exercise stroke (the "strongpoint"). This creates a problem because: (1) sometimes persons doing calisthenics, such as pushups, are unable to lift their body weight through the weakpoint, or, in some cases, through any portion of the exercise stroke; and (2) often the amount of weight weightlifters should use through the strongpoint is too much to lift through the weakpoint, while the amount of weight weightlifters can lift through the weakpoint is too little to sufficiently stimulate the muscles through the strongpoint.

The traditional solutions for exercisers doing calisthenics or using free-weights are: (1) not to do the exercise; (2) to use their bodyweight (for calisthenics) or an amount of weight proper for the strongpoint (for free-weight exercise), but stop the exercise stroke before reaching the weakpoint, that is, to do-only a portion of the exercise stroke; or (3) to perform the entire exercise stroke, but to do fewer repetitions (for calisthenics) or use less weight (for free-weight exercise) than the proper amount for the strongpoint, that is, to stop exercising before the muscles used through the strongpoint are fully exercised. The problem with solution (1) is that the exerciser is deprived of the benefits of that exercise. The problem with solution (2) is that the exerciser does not exercise through the weakpoint and therefore obtain less overall development and less or no development of any muscles that are exercised only through the weakpoint. The problem with solution (3) is that the exerciser obtains less development of the muscles used through the strongpoint.

One attempt at solving the weakpoint problem has been through the use of variable-resistance machines which use weights, cables, pulleys, air pressure or hydraulics (hereinafter "exercise machines"). However, many exercisers continue to do calisthenics and free-weights instead of using exercise machines for many reasons, including: (1) balance is developed when doing calisthenics and using free-weights, but not when using exercise machines; (2) exercise machines have friction generating parts which result in unwanted variation in resistance depending on the age of the machine, how well oiled it is, how tight the bolts are, etc.; (3) calisthenics require little or no equipment and can be done almost anywhere; (4) machines are usually bigger, heavier, more cumbersome, less versatile, and more expensive than free-weights; (5) many exercisers have found or at least believe that calisthenics and free-weight exercise develop power and strength better and more quickly than exercise machines; (6) exercise machines often restrict the path to be followed during an exercise motion, often to an unnatural path, resulting in less efficient muscle development, discomfort, and even injury, especially for exercisers with very short or very long limbs; (7) many weightlifters train for contests in which free-weights are lifted, such as powerlifting or Olympic weightlifting contests, and using free-weights allows them to better duplicate the contest movements; and (8) many schools and training programs incorporate calisthenics and free-weight exercise into their routines.

Exercisers would therefore benefit from an invention that will allow them to: (1) more easily and efficiently do calisthenics and exercise with free-weights; and (2) do calisthenics and use flee-weights while still properly stimulating their muscles through both the weakpoint and the strongpoint. The invention would be even more valuable if it was portable, relatively inexpensive, and relatively simple and easy to manufacture, use, and maintain.

OBJECTS AND ADVANTAGES

This invention overcomes the weakpoint problem while still allowing the exerciser to do calisthenics and use free-weights instead of machines. This invention allows the exerciser to use the optimal weight (usually his body weight when doing calisthenics) through both the weakpoint and the strongpoint, thus obtaining more complete and efficient muscular development than through doing calisthenics or using free-weights alone, while still allowing the exerciser to obtain all the advantages of doing calisthenics and using free-weights instead of using exercise machines. This invention can be used for many different exercise motions, including bench press, military press, squats, pushups, and lat pulls/rowing.

This device can be used singly, to assist exercisers doing calisthenics, or in pairs, to assist weightlifters. This device can be free standing or bolted to the floor. Several versions of the device for pushups and lat pulls/rowing can be folded or collapsed into a large telephone book or binder size and shape, for easy travel and storage. When used with free-weight exercise, this device also can be adjustably and removably mounted to a support structure, such as a standard squat cage (a hexahedron comprised of metal tubing).

As can be seen in FIGS. 1 through 16, this invention utilizes a surface designed to come into contact with the exerciser's body (in the case of pushups and lat pulls/-rowing) or the weight bar (in the case of free-weight exercise) throughout the weakpoint. This surface is connected to a means of generating force, such as springs or pistons, so that it assists the exerciser throughout the weakpoint but has no effect throughout the strongpoint. In this manner, a weightlifter is able to use the greater amount of weight required to fully stimulate the muscles through the strongpoint, and yet continue exercising through the weakpoint without changing the amount of weight being used. Similarly, an exerciser is able to do pushups with his bodyweight, through the entire range of the pushup motion, and then use the same device to do lat pulls/rowing. Thus, by using this invention, the exerciser is allowed to do calisthenics or exercise with freeweights and at the same time perform the optimal number of repetitions and use the optimal amount of weight (his bodyweight in the case of calisthenics) throughout both the weakpoint and the strongpoint, thereby obtaining more complete muscular development. With the above objects in view, reference should be had to the drawings.

DETAILED DESCRIPTIONS OF THE PREFERRED EMBODIMENTS

FIRST PREFERRED EMBODIMENT

Figure 1:
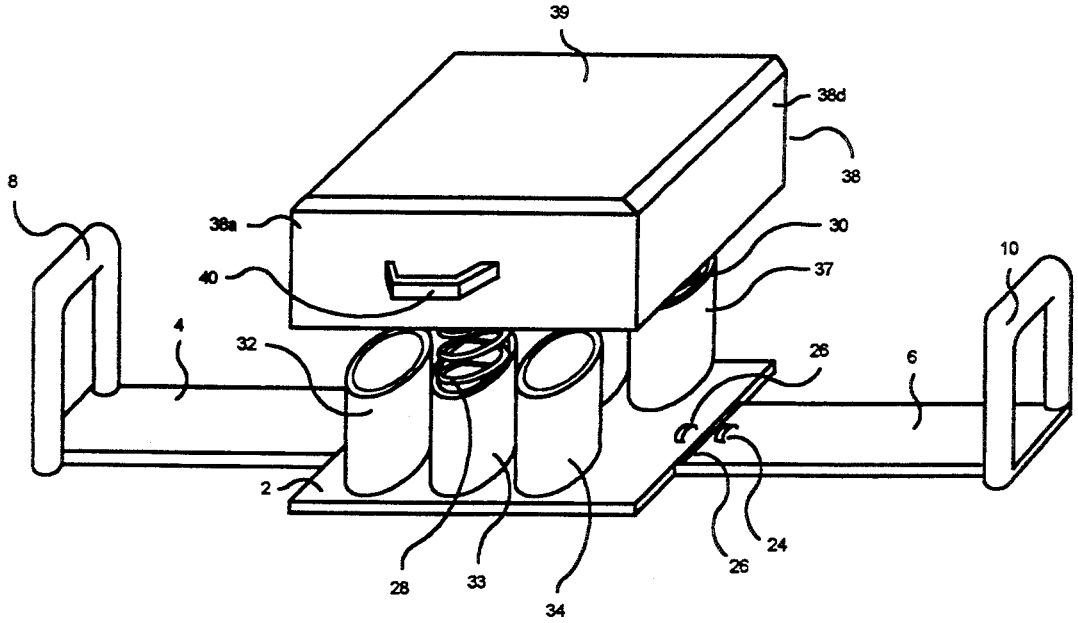
FIG. 1 is an isometric view of the first preferred embodiment as it appears at the beginning of the exercise stroke.
Figure 2:
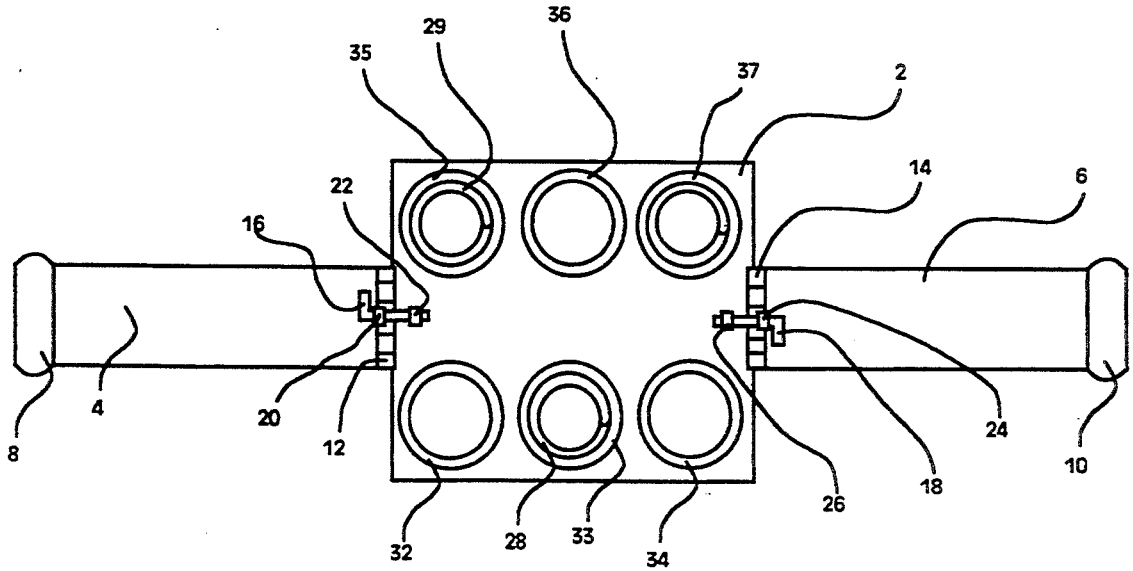
FIG. 2 is a top view of the first preferred embodiment as it appears when set up to be used, but with the upper box removed.
Figure 3:
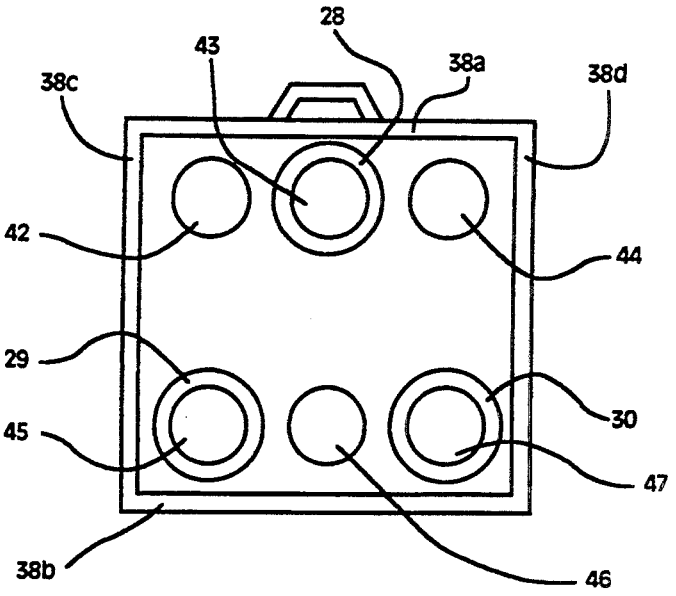
FIG. 3 is a bottom view of the upper box of the first preferred embodiment, as it appears when set up to be used.
Figure 4:
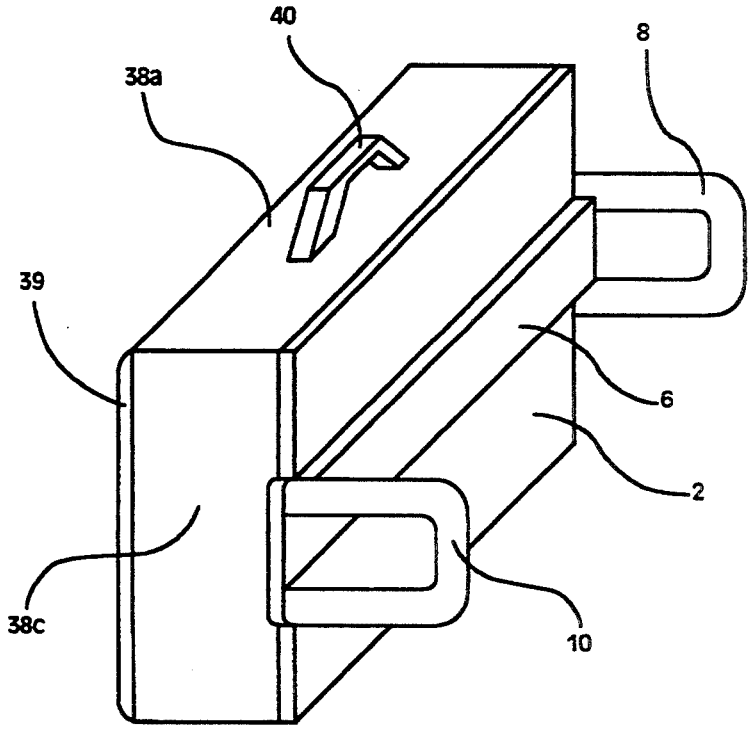
FIG. 4 is an isometric view of the first preferred embodiment as it appears when it has been folded up for travel or storage.

The first preferred embodiment is a portable pushup and lat-pull/rowing device that folds up into the shape and size of a thick binder or telephone book, to easily fit into a briefcase or small suitcase for travel.

The first preferred embodiment is shown in FIGS. 1, 2, 3, and 4. Like reference numbers refer to like parts throughout FIGS. 1, 2, 3, and 4.

This first preferred embodiment is comprised of:

1. A lower metal plate 2, approximately eleven inches long, ten inches wide, and one-half inch thick.
2. Left and right metal extension arms 4 and 6, respectively, each approximately twelve inches long, three inches wide, and one-half inch thick.
3. Left and right metal hand-bars 8 and 10, respectively, connected to the left and right ends, respectively, of the left and right metal extension arms 4 and 6, respectively. The left and right hand-bars 8 and 10 are made of one inch thick circular cross-section tubing bent into upside down U shapes, with the bottoms of the legs attached to the top faces of the left and right ends of extension arms 4 and 6. The left and right handbars 8 and 10 are each four and one-half inches wide and five-and-one-half inches high.
4. Left hinge 12, connecting the right end of the left extension arm 4 to the center of the left edge of the lower plate 2, connected so as to allow the left extension arm 4 to swing or fold over the back of the lower plate 2.
5. Right hinge 14, connecting the left end of the right extension arm 6 to the center of the right edge of the lower plate 2, connected so as to allow the right extension arm 6 to swing or fold over the front of the lower plate 2.
6. Left and right pins 16 and 18, respectively, each two inches long and one-quarter inch thick.
7. Left extension arm pin loop 20, connected to the top of the right end of the left extension arm 4, and having proper dimensions to allow for a snug fit when the left pin 16 is inserted through the left extension arm pin loop 20.
8. Left lower plate pin loop 22, connected to the top of the left end of the lower plate 2, in line with the left extension arm pin loop 20 and of proper dimensions to allow for a snug fit when the left pin 18 is inserted through the left lower plate pin loop 22.
9. Right extension arm pin loop 24, connected to the top of the left end of the right extension arm 4, and having proper dimensions to allow for a snug fit when the right pin 18 is inserted through the right extension arm pin loop 24.

10. 10. Right lower plate pin loop 26, connected to the top of the right end of the lower plate 2, in line with the right extension arm pin loop 24 and of proper dimensions to allow for a snug fit when the right pin 18 is inserted through the right lower plate pin loop 26.

11. Springs 28, 29, and 30, each approximately ten inches long and having a two and one-half inch cross-sectional inner diameter.

12. Front left, middle, and right hollow cylindrical lower spring guides 32, 33, and 34, respectively, each having an inner cylindrical cross-section of proper diameter to allow for a snug fit when the bottoms of the springs 28, 29, and 30 are inserted into the lower spring guides 32, 33, and 34, and each being approximately three and one-half inches in height. The lower spring guides 32, 33, and 34 are vertically attached, facing upward, to the upper face of the lower plate 2. The most forward points of the lower spring guides 32, 33, and 34 are lined up with the front edge of the lower plate 2. The lower spring guides 32, 33, and 34 are located lengthwise so that: (a) the left edge of the lower plate 2 is one-fourth of an inch from the left edge of the left lower spring guide 32; (b) the right edge of the left lower spring guide 32 is touching the left edge of the middle lower spring guide 33; (c) the right edge of the middle lower spring guide 33 is touching the left edge of the right lower spring guide 34; and (d) the right edge of the right lower spring guide 34 is one-fourth of an inch from the right edge of the lower plate 2.

13. Rear left, middle, and right hollow cylindrical lower spring guides 35, 36, and 37, respectively, each having an inner cylindrical cross-section of proper diameter to allow for a snug fit when the bottoms of the springs 28, 29, and 30 are inserted into the lower spring guides 35, 36, and 37, and each being approximately three and one-half inches in height. The lower spring guides 35, 36, and 37 are vertically attached, facing upward, to the upper face of the lower plate 2. The farthest back points of the lower spring guides 35, 36, and 37 are lined up with the rear edge of the lower plate 2. The lower spring guides 35, 36, and 37 are located lengthwise so that: (a) the left edge of the lower plate 2 is one-fourth of an inch from the left edge of the left lower spring guide 35; (b) the right edge of the left lower spring guide 35 is touching the left edge of the middle lower spring guide 36; (c) the right edge of the middle lower spring guide 36 is touching the left edge of the right lower spring guide 37; and (d) the right edge of the right lower spring guide 37 is one-fourth of an inch from the right edge of the lower plate 2.

14. An upper metallic box 38 with an open bottom, made of one-quarter inch thick metal and measuring approximately eleven and one-half inches long, four inches high, and ten and one-half inches wide. The upper metallic box 38 has a front 38*a*, a back 38*b*, a left side 38*c*, a right side 38*d*, and a top 38*e*. One-half inch thick padding 39 is attached to the upper face of the top 38*e* and a carrying handle 40 is attached to the outer face of the front 38*a*.

15. Front left, middle, and right upper plate spring guides 42, 43, and 44, respectively, each having an outer cylindrical cross-section of proper diameter to allow for a snug fit when the springs 28, 29, and 30 are slid over the upper plate spring guides 42, 43, and 44, and each being approximately three and one-half inches in height. The upper spring guides 42, 43, and 44 are vertically attached, facing downward, to the lower face of the top 38*e* of the upper box 38. The most forward points of the upper spring guides 42, 43, and 44 are lined up with a line parallel to and one-fourth of an inch from the front edge of the upper box 38. The upper spring guides 42, 43, and 44 are located lengthwise so that: (a) the left edge of the upper box 38 is one inch from the left edge of the left upper spring guide 42; (b) the right edge of the left upper spring guide 42 is one inch from the left edge of the middle upper spring guide 43; (c) the right edge of the middle upper spring guide 43 is one inch from the left edge of the right upper spring guide 44; and (d) the right edge of the right upper spring guide 44 is one inch from the right edge of the upper box 38.

16. Rear left, middle, and right upper plate spring guides 45, 46, and 47, respectively, each having an outer cylindrical cross-section of proper diameter to allow for a snug fit when the springs 28, 29, and 30 are slid over the upper plate spring guides 45, 46, and 47, and each being approximately three and one-half inches in height. The upper spring guides 45, 46, and 47 are vertically attached, facing downward, to the lower face of the top 38e of the upper box 38. The farthest back points of the upper spring guides 45, 46, and 47 are lined up with a line parallel to and one-fourth of an inch from the rear edge of the upper box 38. The upper spring guides 45, 46, and 47 are located lengthwise so that: (a) the left edge of the upper box 38 is one inch from the left edge of the left upper spring guide 45; (b) the right edge of the left upper spring guide 45 is one inch from the left edge of the middle upper spring guide 46; (c) the right edge of the middle upper spring guide 46 is one inch from the left edge of the right upper spring guide 47; and (d) the right edge of the right upper spring guide 47 is one inch from the right edge of the upper box 38.

17. Different strength springs of the same approximate dimensions as the springs 28, 29, and 30, each calibrated and marked with their respective strength in pounds, preferably in pairs of equal strength springs, each ranging in strength from ten to fifty pounds, in ten pound increments.

The first preferred embodiment is set up for use by unfolding the left and right extension arms 4 and 6 so that they are parallel with the lower plate 2. The left and right extension arms 4 and 6 are locked into place by inserting the left pin 16 through the left extension arm pin loop 20 and the left lower plate pin loop 22 and by inserting the right pin 18 through the right extension arm pin loop 24 and the right lower plate pin loop 26. The lower plate 2 and the extension arms 4 and 6 are then placed on the floor with the handbars 8 and 10 and the lower spring guides 32, 33, 34, 35, 36, and 37 facing vertically upward.

The lower ends of the springs 28, 29, and 30 are placed into the lower spring guides 33, 35, and 37, respectively. The upper box 38 is then held above the lower plate 2 with the padding 39 facing upward, and lowered so that the upper spring guides 43, 45, and 47 slide into the tops of the springs 28, 29, and 30, respectively.

In order to use the first preferred embodiment for pushups, the user clasps the handbars 8 and 10 with his hands and assumes the pushup position, with his chest above the padding 39. The user then performs pushups. As the user's chest moves downward, it comes into contact with the padding 39, forcing the upper box 38 to move downward and compressing the springs 28, 29, and 30. As the springs 28, 29, and 30 are compressed, they generate a resisting upward force on the upper box 38. This upward force, through the padding 39, pushes up on the user's chest, thereby assisting the user in doing the pushups by reducing the amount of weight the user's muscles must lift.

In order to use the first preferred embodiment for lat-pulls or rowing, the user also clasps the handbars 8 and 10 with his hands. The user then does one of the following (at his choosing): (a) the user lies with his back on the floor or on a chair or bench, and then pulls the handbars 8 and 10 toward him in a lat-pull or rowing motion; (b) the user sits upright and pulls the handbars 8 and 10 toward him in a lat-pull or rowing motion; or (c) the user replaces the springs 28, 29, and 30 with springs that generate a total force greater than his body-weight, assumes a pushup position, and pulls his chest toward the floor by pulling on the handbars 8 and 10 in a lat-pull or rowing motion. As the user pulls the handbars 8 and 10 toward his body, the padding 39 comes into contact with his chest. As the user continues to pull on the handles 8 and 10, the springs 28, 29, and 30 are compressed, generating a resisting force on the upper box 38. This resisting force, through the padding 39, pushes against the user's chest, thereby forcing the user to exert force and exercise his back and arm muscles in order to pull the handbars 8 and 10 toward his chest. Thus, the first preferred embodiment used in this manner provides the same benefits as bent over barbell rows, one arm dumbbell rows, or seated pulley (exercise machine) rows.

In the manner described above, the user is able to exercise his upper body muscles. The user is able to exercise his chest, shoulders, triceps, and other miscellaneous muscles by doing pushups, and the user is able to exercise his back, biceps, and other miscellaneous muscles by doing lat pulls or rowing.

By replacing the springs 28, 29, and 30 with different strength springs, the user can adjust the amount of assistance provided during pushups and the difficulty of the lat pulls/rowing to match his fitness level and training needs. As the user's strength increases, a user can reduce the amount of assistance provided during pushups by using lower strength springs and can increase the resistance during lat pulls/rowing by using higher strength springs. By using the first preferred embodiment in this manner, a user will be able to continue to increase his strength and fitness level, and will not outgrow the first preferred embodiment.

While this first preferred embodiment is of greatest benefit to persons who are unable to do any or more than a few pushups, the first preferred embodiment is also of value to exercisers who are already proficient at doing pushups. First, the first preferred embodiment can be used for lat pulls/rowing. Second, the first preferred embodiment can be used in the manner described above for pushups to allow the exerciser to do additional pushups once he has reached the point where he cannot do any more without assistance (whether that be after three or ninety pushups).

After use, the first preferred embodiment can be folded into a briefcase size and shape as follows: (1) the upper box 38 is lifted off of the springs 28, 29, and 30; (2) the springs 28, 29, and 30 are lifted out of the lower spring guides 32, 33, 34, 35, 36, and 37; (3) the pins 16 and 18 are removed; (4) the left extension arm 4 is folded over the back of the lower plate 2 so that it is flat against the lower face of lower plate 2; (5) the right extension arm 6 is folded over the front of the lower plate 2 so that it is flat against the upper face of lower plate 2; (6) the springs 28, 29, and 30, and the pins 16 and 18, are placed into the upper box 38; (7) the upper box 38 is attached to the lower plate 2, thereby forming a briefcase shape approximately eleven and one-half inches by ten and one-half inches by four inches, with a handle 40 for easy travel or storage.

SECOND PREFERRED EMBODIMENT

The second preferred embodiment is a portable pushup and lat-pull device, with horizontally-adjustable hand-bars, that is easily disassembled and reassembled into a large binder or telephone book size and shape for easy travel.

Figure 5:
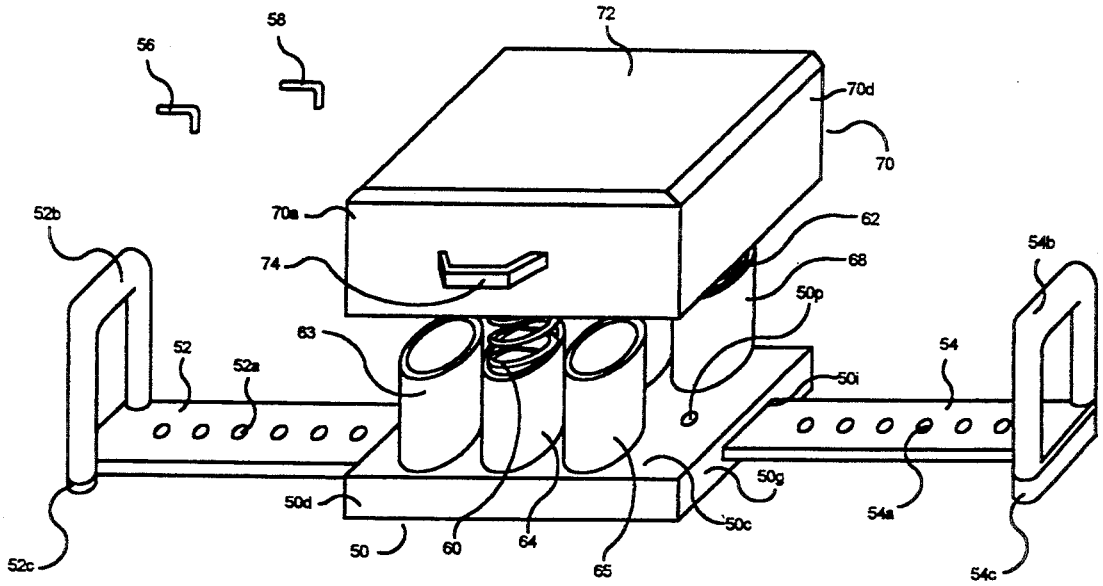
FIG. 5 is an isometric view of the second preferred embodiment as it appears at the beginning of the exercise stroke.
Figure 6:
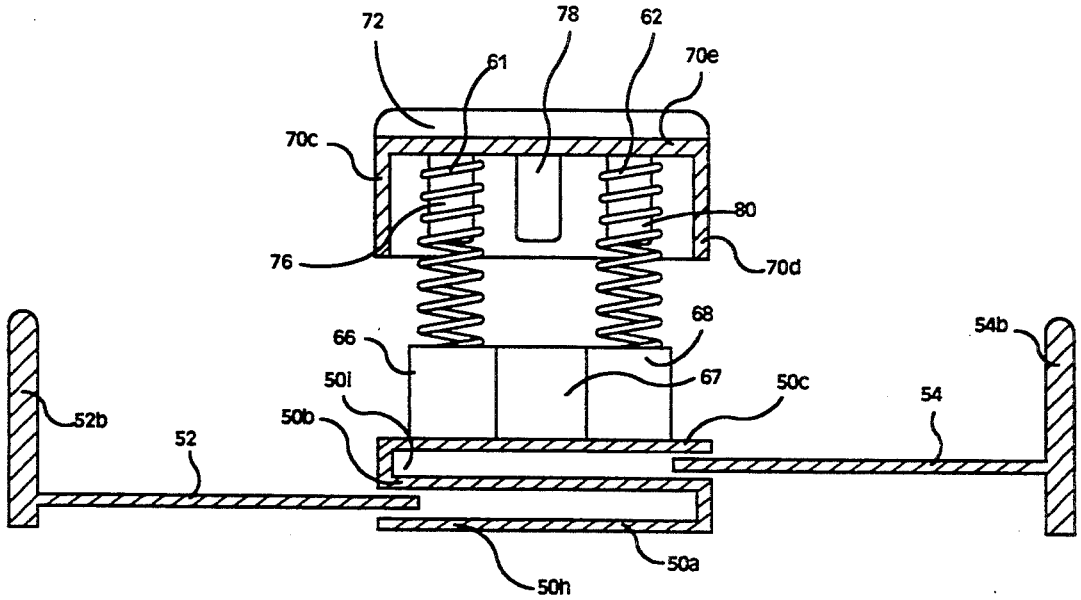
FIG. 6 is a cut-away view of the second preferred embodiment as it appears at the beginning of the exercise stroke, when cut along a vertical plane parallel to the fronts of the upper and lower boxes, and running through the midpoints of the sides of the upper and lower boxes.
Figure 7:
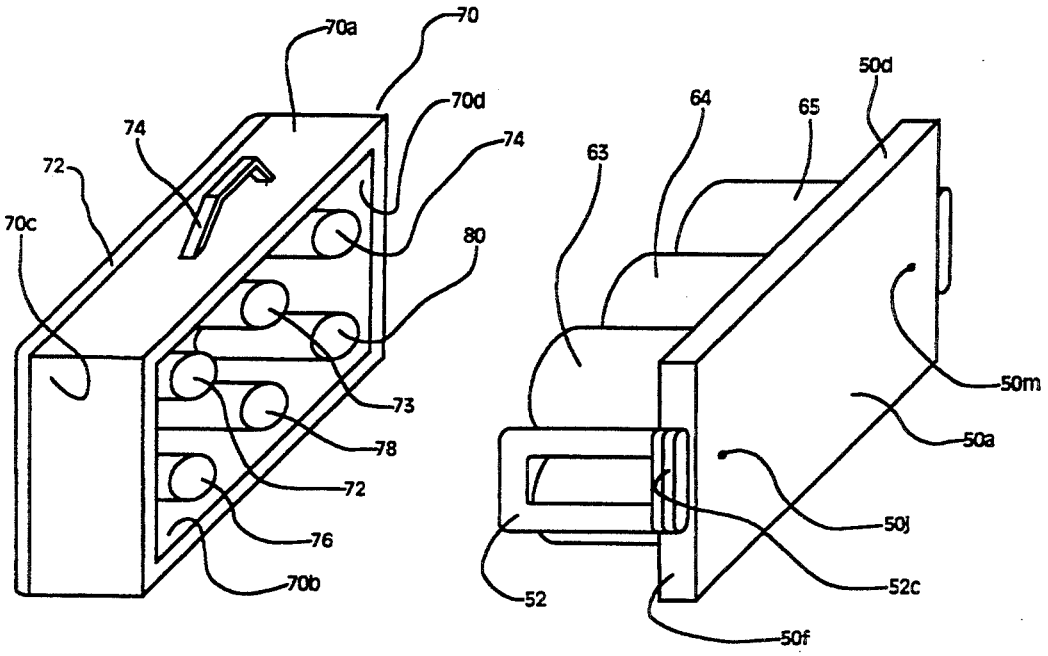
FIG. 7 is an isometric view of the second preferred embodiment as it appears just before it is closed up for travel or storage.

The second preferred embodiment is shown in FIGS. 5, 6, and 7. Like reference numbers refer to like parts throughout FIGS. 5, 6, and 7.

The second preferred embodiment is comprised of:

1. A lower metal box 50, approximately eleven inches long, seven inches wide, and one and three-fourths inches high, and made of one-quarter inch thick metal. The lower metal box 50 has a bottom plate **50*a*, a middle plate 50*b*, a top plate 50*c*, a front face 50*d*, a back face 50*e*, a left face 50*f*, and a right face 50*g*. The bottom plate 50*a*, middle plate 50*b*, and top plate 50*c* are stacked one on top of the other, parallel to each other with one-half inch of space between them, and with the bottom edge of bottom plate 50*a* being level with the bottom edges of the top, bottom, left, and right faces 50*d*, 50*e*, 50*f*, and 50*g*. The left face 50*f* has a one-half inch high and three inches wide horizontal slit 50*h*, centered horizontally and with the bottom of the slit 50*h* located one-quarter inch above the bottom of the left face 50*f*, in line with and opening into the space between bottom plate 50*a* and middle plate 50*b*. The right face 50*g* has a one-half inch high and three inches wide horizontal slit 50*i*, centered horizontally and with the bottom of the slit 50*i* located one inch above the bottom of the right face 50*g*, in line with and opening into the space between middle plate 50*b* and top plate 50*c*. The bottom, middle, and top plates 50*a*, 50*b*, and 50*c* each have left one-quarter inch diameter holes 50*j*, 50*k*, and 50*m*, respectively, located along a line drawn through the center of the width of top plate 50*c* and located three-fourths inch to the right of the left edge of top plate 50*c*. The bottom, middle, and top plates 50*a*, 50*b*, and 50*c* each have right one-quarter inch diameter holes 50*m*, 50*o*, and 50*p*, respectively, located along a line drawn through the center of the width of top plate 50*c* and located three-fourths of an inch left of the right edge of top plate 50*c***.
2. Left and right metal extension arms 52 and 54, respectively, each approximately twelve inches long, three inches wide, and one-half inch thick. The left and right metal extension arms 52 and 54 each have a series of one-quarter inch diameter vertical holes **52*a* and 54*a*, respectively, that pass through the extension arms 52 and 54 and that are spaced approximately one inch apart along the lengths of extension arms 52 and 54**.

3. Left and right metal hand-bars 52*b* and 54*b*, respectively, connected to the left and right ends, respectively, of the left and right extension arms 52 and 54, respectively. The left and right hand-bars 52*b* and 54*b* are made of one inch thick circular cross-section tubing bent into upside down U shapes, with the bottoms of the legs attached to the top faces of the left and right ends of extension arms 52 and 54. The left handbar 52*b* is four inches wide and five-and-one-quarter inches high. The right handbar 54*b* is four inches wide and five inches high.
4. Left metal block 52*c*, one-quarter inch high, one inch long, and four inches wide, attached to the bottom of the left end of the left extension arm 52.
5. Right metal block 54*c*, one inch high, one inch long, and four inches wide, attached to the bottom of the right end of the right extension arm 54.
6. Left and right pins 56 and 58, respectively, each one-quarter inch in diameter. The left pin 56 is one-and-three-quarters inches long and the right pin 58 is one inch long.
7. Springs 60, 61, and 62, each approximately ten inches long and having a three inch outer cross-sectional diameter.
8. Front left, middle, and right hollow cylindrical lower spring guides 63, 64, and 65, respectively, each having an inner cylindrical cross-section of proper diameter to allow for a snug fit when the bottoms of the springs 60, 61, and 62 are inserted into the lower spring guides 63, 64, and 65, and each being approximately three and one-half inches in height. The lower spring guides 63, 64, and 65 are vertically attached, facing upward, to the upper face of the top plate 50*c*. The most forward points of the lower spring guides 63, 64, and 65 are lined up with the front edge of the top plate 50*c*. The lower spring guides 63, 64, and 65 are located lengthwise so that: (a) the left edge of the top plate 50*c* is one-fourth of an inch from the left edge of the left lower spring guide 63; (b) the right edge of the left lower spring guide 63 is touching the left edge of the middle lower spring guide 64; (c) the right edge of the middle lower spring guide 64 is touching the left edge of the right lower spring guide 65; and (d) the right edge of the right lower spring guide 65 is one-fourth of an inch from the right edge of the top plate 50*c*.
9. Rear left, middle, and right hollow cylindrical lower spring guides 66, 67, and 68, respectively, each having an inner cylindrical cross-section of proper diameter to allow for a snug fit when the bottoms of the springs 60, 61, and 62 are inserted into the lower spring guides 66, 67, and 68, and each being approximately three and one-half inches in height. The lower spring guides 66, 67, and 68 are vertically attached, facing upward, to the upper face of the top plate 50*c*. The farthest back points of the lower spring guides 66, 67, and 68 are lined up with the rear edge of the top plate 50*c*. The lower spring guides 66, 67, and 68 are located lengthwise so that: (a) the left edge of the top plate 50*c* is one-fourth of an inch from the left edge of the left lower spring guide 66; (b) the right edge of the left lower spring guide 66 is touching the left edge of the middle lower spring guide 67; (c) the right edge of the middle lower spring guide 67 is touching the left edge of the right lower spring guide 68; and (d) the right edge of the right lower spring guide 68 is one-fourth of an inch from the right edge of the top plate 50*c*.
10. An upper metallic box 70 with an open bottom, made of one-quarter inch thick metal and measuring approximately eleven and one-half inches long, four inches high, and seven and one-half inches wide. The upper metallic box 70 has a front 70*a*, a back 70*b*, a left side 70*c*, a right side 70*d*, and a top 70*e*. One-half inch thick padding 72 is attached to the upper face of the top 70*e* and a carrying handle 74 is attached to the outer face of the front 70*a*.
11. Front left, middle, and right upper plate spring guides 72, 73, and 74, respectively, each having an outer cylindrical cross-section of proper diameter to allow for a snug fit when the springs 60, 61, and 62 are slid over the upper plate spring guides 72, 73, and 74, and each being approximately three and one-half inches in height. The upper spring guides 72, 73, and 74 are vertically attached, facing downward, to the lower face of the top 70*e* of the upper box 70. The most forward points of the upper spring guides 72, 73, and 74 are lined up with a line parallel to and one-fourth of an inch from the front edge of the upper box 70. The upper spring guides 72, 73, and 74 are located lengthwise so that: (a) the left edge of the upper box 70 is one inch from the left edge of the left upper spring guide 72; (b) the right edge of the left upper spring guide 72 is one inch from the left edge of the middle upper spring guide 73; (c) the right edge of the middle upper spring guide 73 is one inch from the left edge of the right upper spring guide 74; and (d) the right edge of the right upper spring guide 74 is one inch from the right edge of the upper box 70.
12. Rear left, middle, and right upper plate spring guides 76, 78, and 80, respectively, each having an outer cylindrical cross-section of proper diameter to allow for a snug fit when the springs 60, 61, and 62 are slid over the upper plate spring guides 76, 78, and 80, and each being approximately three and one-half inches in height. The upper spring guides 76, 78, and 80 are vertically attached, facing downward, to the lower face of the top 70*e* of the upper box 70. The farthest back points of the upper spring guides 76, 78, and 80 are lined up with a line parallel to and one-fourth of an inch from the rear edge of the upper box 70. The upper spring guides 76, 78, and 80 are located lengthwise so that: (a) the left edge of the upper box 70 is one inch from the left edge of the left upper spring guide 76; (b) the right edge of the left upper spring guide 76 is one inch from the left edge of the middle upper spring guide 78; (c) the right edge of the middle upper spring guide 78 is one inch from the left edge of the right upper spring guide 80; and (d) the right edge of the right upper spring guide 80 is one inch from the right edge of the upper box 70.
13. Different strength springs of the same approximate dimensions as the springs 60, 61, and 62, each calibrated and marked with their respective strength in pounds, preferably in pairs of equal strength springs, each ranging in strength from ten to sixty pounds, in ten pound increments.

The second preferred embodiment is set up for use by pulling out the left and right extension arms 52 and 54 until the handbars 52*b* and 54*b* are the same distance apart as the user wishes to place his hands while exercising. The left and right extension arms 52 and 54 are locked into place by inserting the left pin 56 through the left one-quarter inch diameter holes 50*j* and 50*k*, and by inserting the right pin 58 through the right one-quarter inch diameter holes 50*m*, 50*o*, and 50*p*. The lower box 50 and extension arms 52 and 54 are then placed on the floor with the handbars 52*b* and 54*b* and the lower spring guides 64, 66, and 68 facing vertically upward.

The lower ends of springs 60, 61, and 62 are placed into the lower spring guides 64, 66, and 68, respectively. The upper box 70 is then held above the lower box 50 with the padding 72 facing upward, and lowered so that the tops of springs 60, 61, and 62 slide over the upper spring guides 76, 78, and 80, respectively.

In order to use the second preferred embodiment for pushups, a user clasps the handbars 52*b* and 54*b* with his hands and assumes the pushup position, with his chest above the padding 70. The user then performs pushups. As the user's chest moves downward, it comes into contact with the padding 72, forcing the upper box 70 to move downward and compressing the springs 60, 61, and 62. As the springs 60, 61, and 62 are compressed, they generate a resisting upward force on the upper box 70. This upward force, through the padding 72, pushes up on the user's chest, thereby assisting the user in doing the pushups by reducing the amount of weight the user's muscles must lift.

In order to use the second preferred embodiment for lat-pulls or rowing, the user also clasps the handbars 52*b* and 54*b* with his hands. The user then does one of the following (at his choosing): (a) the user lies with his back on the floor or on a chair or bench, and then pulls the handbars 52*b* and 54*b* toward him in a lat-pull or rowing motion; (b) the user sits upright and pulls the handbars 52*b* and 54*b* toward him in a lat-pull or rowing motion; or (c) the user replaces the springs 60, 61, and 62 with springs that generate a total force greater than his body-weight, assumes a pushup position, and pulls his chest toward the floor by pulling on the handbars 52*b* and 54*b* in a lat-pull or rowing motion. As the user pulls the handbars 52*b* and 54*b* toward his body, the padding 72 comes into contact with his chest. As the user continues to pull on the handles 52*b* and 54*b*, the springs 60, 61, and 62 are compressed, generating a resisting force on the upper box 70. This resisting force, through the padding 72, pushes against the user's chest, thereby forcing the user to exert force and exercise his back and arm muscles in order to pull the handbars 52*b* and 54*b* toward his chest. Thus, the second preferred embodiment used in this manner provides the same benefits as bent over barbell rows, one arm dumbbell rows, or seated pulley (exercise machine) rows.

In the manner described above, the user is able to exercise his upper body muscles. The user is able to exercise his chest, shoulders, triceps, and other miscellaneous muscles by doing pushups, and the user is able to exercise his back, biceps, and other miscellaneous muscles by doing lat pulls or rowing.

By replacing the springs 60, 61, and 62 with different strength springs, or by removing or adding springs, a user can adjust the amount of assistance provided during pushups and the difficulty of the lat pulls/rowing to match his or her fitness level and training needs. As a user's strength increases, he or she can reduce the amount of assistance provided during pushups by using fewer or lower strength springs and can increase the resistance during lat pulls/rowing by using more or higher strength springs. By using the second preferred embodiment in this manner, a user will be able to continue to increase his or her strength and fitness level, and will not out-grow the second preferred embodiment.

A user can focus on developing different muscles by simply removing the pins 56 and 58, sliding the handbars 52*b* and 54*b* closer or farther apart, and then reinserting the pins 56 and 58.

While this second preferred embodiment is of greatest benefit to persons who are unable to do any or more than a few pushups, the second preferred embodiment is also of value to exercisers who are already proficient at doing pushups. First, the second preferred embodiment can be used for lat pulls/rowing. Second, the second preferred embodiment can be used in the manner described above for pushups to allow an exerciser to do additional pushups once he has reached the point where he cannot do any more without assistance (whether that be after three or ninety pushups). Third, if it is difficult for a user to do pushups with his or her hands spaced far apart, he or she can still obtain the benefits of that exercise by adjusting the distance between the handbars 52*b* and 54*b* and the number and/or strength of the springs 60, 61, and 62 so that he or she receives enough assistance to do pushups with his or her hands spaced far apart.

After use, the second preferred embodiment can be converted into a briefcase size and shape as follows: (1) the upper box 70 is lifted off of the springs 60, 61, and 62; (2) the springs 60, 61, and 62 are lifted out of the lower spring guides 64, 66, and 68; (3) the pins 56 and 58 are removed; (4) the left extension arm 52 is slid through slot 50*j* into the lower box 50 so that the left handbar 52*b* is fiat against the left side 50*f* of the lower box 50; (5) the right extension arm 54 is slid through slot 50*i* into the lower box 50 so that the right handbar 54*b* is flat against the right side 50*g* of the lower box 50; and (6) the upper box 70 is attached to the lower box 50, thereby forming a briefcase shape approximately eleven and one-half inches by ten and one-half inches by four inches, with a handle 74 for easy travel or storage.

THIRD PREFERRED EMBODIMENT

The third preferred embodiment is the same as the first preferred embodiment except that it has a taller lower plate, flat handplates instead of handbars, and narrower extension arms that are of proper shape to be comfortably grasped by an exerciser's hands.

Figure 8:
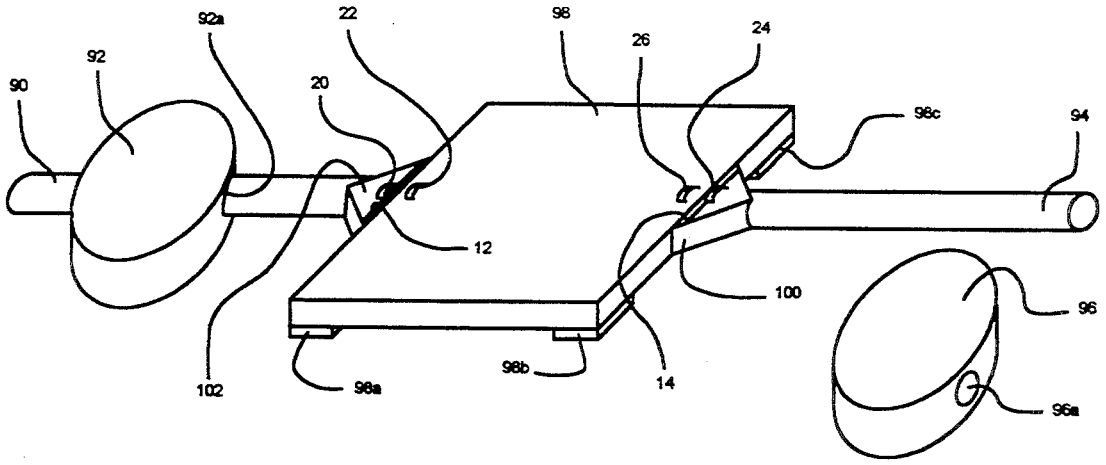
FIG. 8 is an isometric view of the lower box, handplates, and extension arms of the third preferred embodiment as it appears at the beginning of the exercise stroke.

The lower plate, extension arms, and handplates of the third preferred embodiment are shown in FIG. 8. Like reference numbers refer to like parts throughout FIG. 8.

With reference to FIG. 8, this third preferred embodiment is comprised of the same parts as the first preferred embodiment as shown in FIGS. 1, 2, 3, and 4, except that the extension arms 4 and 6 are replaced with left and right extension bars 90 and 94, respectively; the handbars 8 and 10 are replaced with left and right flat handplates 92 and 96, respectively; and the lower plate 2 is replaced with lower plate 98, as follows:

1. The lower plate 98 is made of one-quarter inch thick metal, and is in the shape of a rectangular hexahedron measuring one inch high, eleven inches long, and ten inches wide. The lower plate 98 has four footings, one located on the bottom in each corner, each approximately one-quarter inch high, one and one-half inches long, and one and one-half inches wide.

2. The left extension bar 90 is a twelve-inch long metal bar with a one-inch diameter circular cross-section. The right end of the left extension bar 90 is rigidly attached to the left end of left support bracket 102.
3. The right extension bar 94 is a twelve-inch long metal bar with a one-inch diameter circular cross-section. The left end of the right extension bar 94 is rigidly attached to the right end of right support bracket 100.
4. The left handplate 92 is an ellipse from a top view, roughly the size and shape of a hand. The left handplate 92 is one and one-half inches high, eight inches wide (at the middle), and four inches long (at the middle). The left handplate 92 has a one and one-sixty-fourths inch diameter circular cross-section hole 92*a* that passes completely through the left handplate 92, and that is centered along an axis running from left to right through the middle of the left handplate 92, so that the cross-section of the hole 92*a* is perpendicular to the top face of the left handplate 92.
5. The right handplate 96 is an ellipse from a top view, roughly the size and shape of a hand. The right handplate 96 is one and one-half inches high, eight inches wide (at the middle), and four inches long (at the middle). The right handplate 96 has a one and one-sixty-fourths inch diameter circular cross-section hole 96*a* that passes completely through the right handplate 96, and that is centered along an axis running from left to right through the middle of the right handplate 96, so that the cross-section of the hole 96*a* is perpendicular to the top face of the right handplate 96.
6. The right end of the left support bracket 102 is attached to the lower plate 98 with the left hinge 12.
7. The left end of the right support bracket 100 is attached to the lower plate 98 with the right hinge 14.
8. The left and right extension bar pin loops 20 and 24 are attached to the tops of the left and right brackets 102 and 100, respectively.
9. The left and right lower plate pin loops 22 and 26 are connected to the tops of the left and right edges of the lower plate 98.

The third preferred embodiment is set up in the same manner as the first preferred embodiment, except that during pushups the left and right extension bars 90 and 94 are slid through the holes 92*a* and 96*a*, respectively, so that the top faces of the handplates 92 and 96 are parallel to the top face of the lower plate 98. The distance between the handplates 92 and 96 is then set by sliding the handplates 92 and 96 closer or farther apart along the left and right extension bars 90 and 94. The handplates 92 and 96 are removed during tat pulls/rowing.

The third preferred embodiment is used in the same manner as the first preferred embodiment, except that during pushups the user's hands are placed flat on the handplates 94 and 96, and during lat pulls/rowing the user clasps his hands around the extension bars 90 and 94 however far apart is comfortable. The user can concentrate on developing different muscles during pushups by simply moving the handplates 92 and 96 closer together or farther apart along the extension bars 90 and 94. The user can also concentrate on developing different muscles during lat pulls/rowing by simply moving his hands closer together or farther apart along the extension bars 90 and 94.

The third preferred embodiment is folded up in the same manner as the first preferred embodiment, except that the handplates 92 and 96 are first removed from the extension bars 90 and 94, respectively.

FOURTH PREFERRED EMBODIMENT

The fourth preferred embodiment is the same as the first preferred embodiment except that it has adjustable-height handbars.

Figure 9:
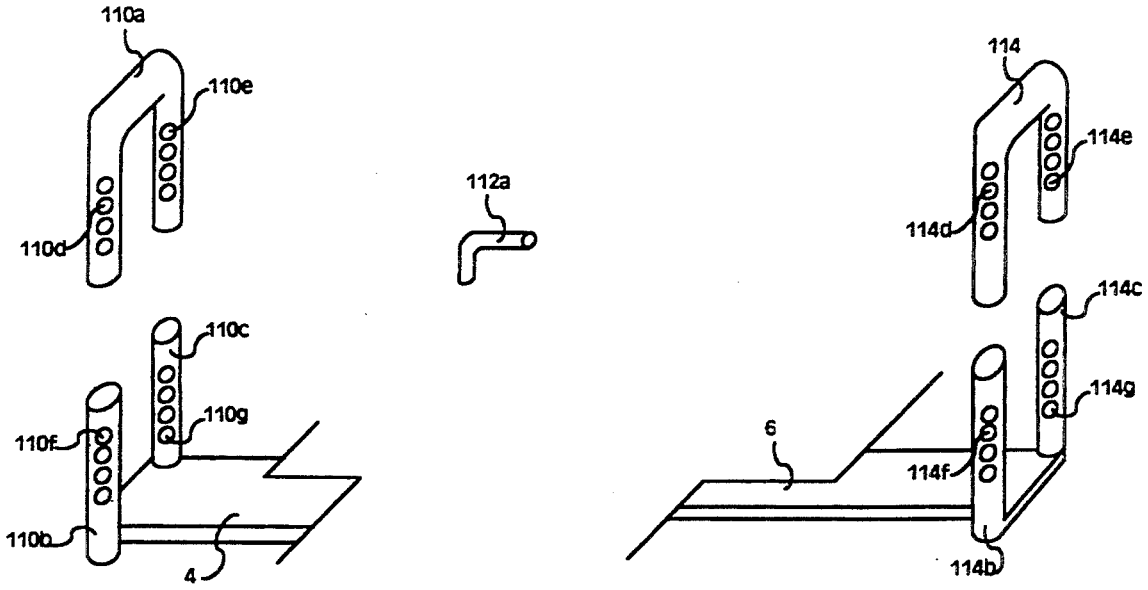
FIG. 9 is an isometric view of the adjustable height handbars of the fourth preferred embodiment.

The adjustable-height handbars of the fourth preferred embodiment are shown in FIG. 9. Like reference numbers refer to like parts throughout FIG. 9.

With reference to FIG. 9, this fourth preferred embodiment is comprised of the same parts as the first preferred embodiment as shown in FIGS. 1, 2, 3, and 4, except that the handbars 8 and 10 are replaced with left and right adjustable height handbars 110 and 114, respectively, as follows:

1. The left adjustable height handbar 110 is connected to the left end of the left extension arm 4. The left handbar 110 is comprised of:
   a. A top portion 110*a*, made of one-eighth inch thick, one and one-quarter inch diameter circular cross-section hollow metal tubing bent into an upside down U shape, with the bottoms of the legs being open and facing downward. The top portion 110*a* is four and one-half inches wide and five-and-one-quarter inches high. The front leg of the top portion 110*a* has four one-quarter inch diameter horizontal holes 110*d* that pass through the front leg of the top portion 110*a* and that are spaced approximately one inch apart along the length of the left leg of the top portion 110*a*. The back leg of the top portion 110*a* also has four one-quarter inch diameter horizontal holes 110*e* that pass through the back leg of the top portion 110*a* and that are spaced approximately one inch apart along the lengths of the right leg of the top portion 110*a*
   b. Front lower leg 110*b* made of one-eighth inch thick, one inch diameter circular cross-section hollow metal tubing, five inches high, and perpendicularly attached to the front-left comer of the top face of the left end of the left extension arm 4. The front lower leg 110*b* has four one-quarter inch diameter horizontal holes 110*f* that pass through the front lower leg 110*b* and that are spaced approximately one inch apart along the length of the front lower leg 110*b*.
   c. Back lower leg 110*c* made of one-eighth inch thick, one inch diameter circular cross-section hollow metal tubing, five inches high, and perpendicularly attached to the front-left comer of the top face of the left end of the left extension arm 4. The back lower leg 110*c* has four one-quarter inch diameter horizontal holes 110*g* that pass through the back lower leg 110*c* and that are spaced approximately one inch apart along the length of the back lower leg 110*c*.
2. Front left pin 112*a*, two inches long and made of one-quarter inch diameter circular cross-section metal. Back left pin 112*b*, front right pin 112*c*, and back right pin 112*d*, not shown, but each identical to the front left pin 112*a*.

3. The right adjustable height handbar 114 is connected to the right end of the right extension arm 6. The right handbar 114 is comprised of:
   a. A top portion 114*a*, made of one-eighth inch thick, one and one-quarter inch diameter circular cross-section hollow metal tubing bent into an upside down U shape, with the bottoms of the legs being open and facing downward. The top portion 114*a* is four and one-half inches wide and five-and-one-quarter inches high. The front leg of the top portion 114*a* has four one-quarter inch diameter horizontal holes 114*d* that pass through the front leg of the top portion 114*a* and that are spaced approximately one inch apart along the length of the right leg of the top portion 114*a*. The back leg of the top portion 114*a* also has four one-quarter inch diameter horizontal holes 114*e* that pass through the back leg of the top portion 114*a* and that are spaced approximately one inch apart along the lengths of the back leg of the top portion 114*a*
   b. Front lower leg 114*b* made of one-eighth inch thick, one inch diameter circular cross-section hollow metal tubing, five inches high, and perpendicularly attached to the front-right corner of the top face of the right end of the right extension arm 6. The front lower leg 114*b* has four one-quarter inch diameter horizontal holes 114*f* that pass through the front lower leg 114*b* and that are spaced approximately one inch apart along the length of the front lower leg 114*b*.
   c. Back lower leg 114*c* made of one-eighth inch thick, one inch diameter circular cross-section hollow metal tubing, five inches high, and perpendicularly attached to the front-right corner of the top face of the right end of the right extension arm 6. The back lower leg 114*c* has four one-quarter inch diameter horizontal holes 114*g* that pass through the back lower leg 114*c* and that are spaced approximately one inch apart along the length of the back lower leg 114*c*.

The fourth preferred embodiment is set up, used, and folded up in the same manner as the first preferred embodiment, except that the user is able to adjust the height of the top portions 110*a* and 114*a* of the handbars 110 and 114. The height of top portion 110*a* is adjusted by removing the pins 112*a* and 112*b*, raising or lowering the top portion 110*a* to the desired height, and then inserting the front pin 112*a* through the proper height holes 110*d* and 110*f* and inserting the back pin 112*b* through the corresponding holes 110*e* and 110*g*. The height of top portion 114*a* is adjusted by removing the pins 112*c* and 112*d*, raising or lowering the top portion 114*a* to the desired height, and then inserting the front pin 118 through the proper height holes 114*d* and 114*f* and inserting the back pin 120 through the corresponding holes 114*e* and 114*g*.

When the height of the top portions 110*a* and 114*a* of the handbars 110 and 114 is decreased, the length of the pushup movement is decreased and the portion of the pushup movement during which assistance is provided is increased, thereby making it easier to perform the pushups. Similarly, during lat pulls/rowing, when the height of the top portions 110*a* and 114*a* of the handbars 110 and 114 is decreased, the portion of the lat pull/rowing movement that is past the weakpoint (when the elbows are pulled back past the body) is decreased and the portion of the lat pull/rowing movement during which assistance is provided is increased, thereby making it easier to perform the lat pulls/rowing.

By adjusting the height of the top portions 110*a* and 114*a* of the handbars 110 and 114, the user is able to better match his exercise needs. During both pushups and lat pulls/rowing, an advanced exerciser would increase and a novice would decrease the height of the top portions 110*a* and 114*a* of the handbars 110 and 114.

FIFTH PREFERRED EMBODIMENT

The fifth preferred embodiment is the same as the second preferred embodiment, except that the lower box has a circular cross-section hole running through it instead of rectangular cross-section slots, it has no extension arms but instead is designed to use a standard barbell for extension arms, and it has interchangeable handplates and hand-bars that are horizontally adjustable.

Figure 10:
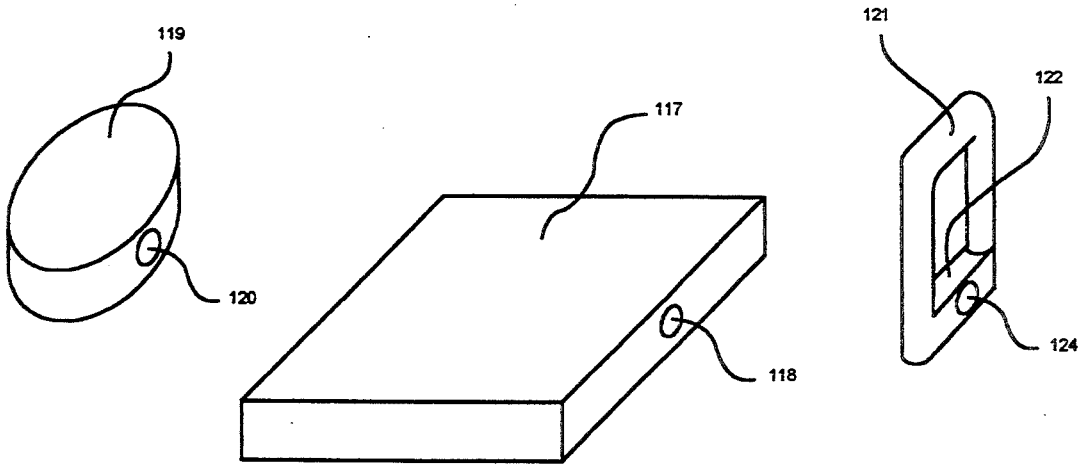
FIG. 10 is an isometric view of the lower box, handplates, and handbars of the fifth preferred embodiment.

The lower box and interchangeable handplates and handbars of the fifth preferred embodiment are shown in FIG. 10. Like reference numbers refer to like parts throughout FIG. 10.

With reference to FIG. 10, this fifth preferred embodiment is comprised of the same parts as the second preferred embodiment as shown in FIGS. 5, 6, and 7, except that it has no extension arms 52 and 54, the handbars 52*b* and 54*b* are replaced with interchangeable pairs of handplates 119 or handbars 121, and the lower box 50 is replaced with a lower box 117 having a circular cross-section hole 118 running through it, as follows:

1. The lower metal box 117 is approximately ten inches long, seven inches wide and one and one-half inches high. The lower metal box 117 has a circular cross-section hole 118 running through it. The hole 118 has a one and one-sixteenth inch diameter cross-section, and runs horizontally through the lower box 117 along an axis that connects the midpoint of the left face of the lower box 117 to the midpoint of the right face of the lower box 117.
2. A pair of handplates identical to handplate 119. The handplate 119 is identical to the handplate 92 of the third preferred embodiment, as shown in FIG. 8, except that the handplate 119 has a one and one-sixteenth inch diameter hole 120 instead of a one and one-sixty-fourths inch diameter hole like the hole 92*a* in the handplate 92. The hole 120 has a one and one-sixteenth inch diameter cross-section, and runs horizontally through the handplate 119 along an axis that connects the midpoint of the left face of the handplate 119 to the midpoint of the right face of the handplate 119.
3. A pair of handbars identical to handbar 121. The handbar 121 is identical to the handbar 52*b* of the second preferred embodiment, except that the bottoms of the lower legs of the handbar 121 are attached to a lower support block 122 instead of being attached to extension arms. The lower support block 122 is approximately one and one-quarter inches long, one and one-half inches high, and four and one-half inches wide. The lower support block 122 has a circular cross-section hole 124 running through it. The hole 124 has a one and one-sixteenth inch diameter cross-section, and runs horizontally through the support block 122 along an axis that connects the midpoint of the left face of the support block 122 to the midpoint of the right face of the support block 122.

In use, a standard one-inch diameter barbell is slid through the hole 118 so that an equal length of it is exposed on the left and right sides of the lower box 117. If desired, an exerciser may then secure the position of the barbell with standard barbell collars.

To do pushups, an exerciser selects a pair of handplates 119 or handbars 121, and slides each barbell end through the respective holes 120 or 124, until the handplates 119 or the handbars 121 are the desired distance apart. The distance between the handplates 119 and handbars 121 is adjusted in the same manner and to the same effect as in the third preferred embodiment.

To do lat pulls/rowing, an exerciser either (a) attaches the handbars 121 and performs lat pulls/rowing in the same manner and to the same effect as in the second preferred embodiment, or (b) removes the handplates 119 or the handbars 121, grasps each barbell end, and performs lat pulls/rowing in the same manner and to the same effect as in the third preferred embodiment.

Except for the differences described in the previous three paragraphs, the fifth preferred embodiment is set up and used in the same manner as the second preferred embodiment. The fifth preferred embodiment is disassembled by sliding the handplates 119 or the handbars 121 off each barbell end, removing the barbell, lifting the upper box 72 off of the springs 60, 61, and 62, removing the springs 60, 61, and 62, and sliding the upper box 72 over the lower box 117.

SIXTH PREFERRED EMBODIMENT

The sixth preferred embodiment is a portable pushup device, with hand-bars that are vertically and horizontally adjustable, that is easily disassembled for easy storage and travel.

Figure 11:
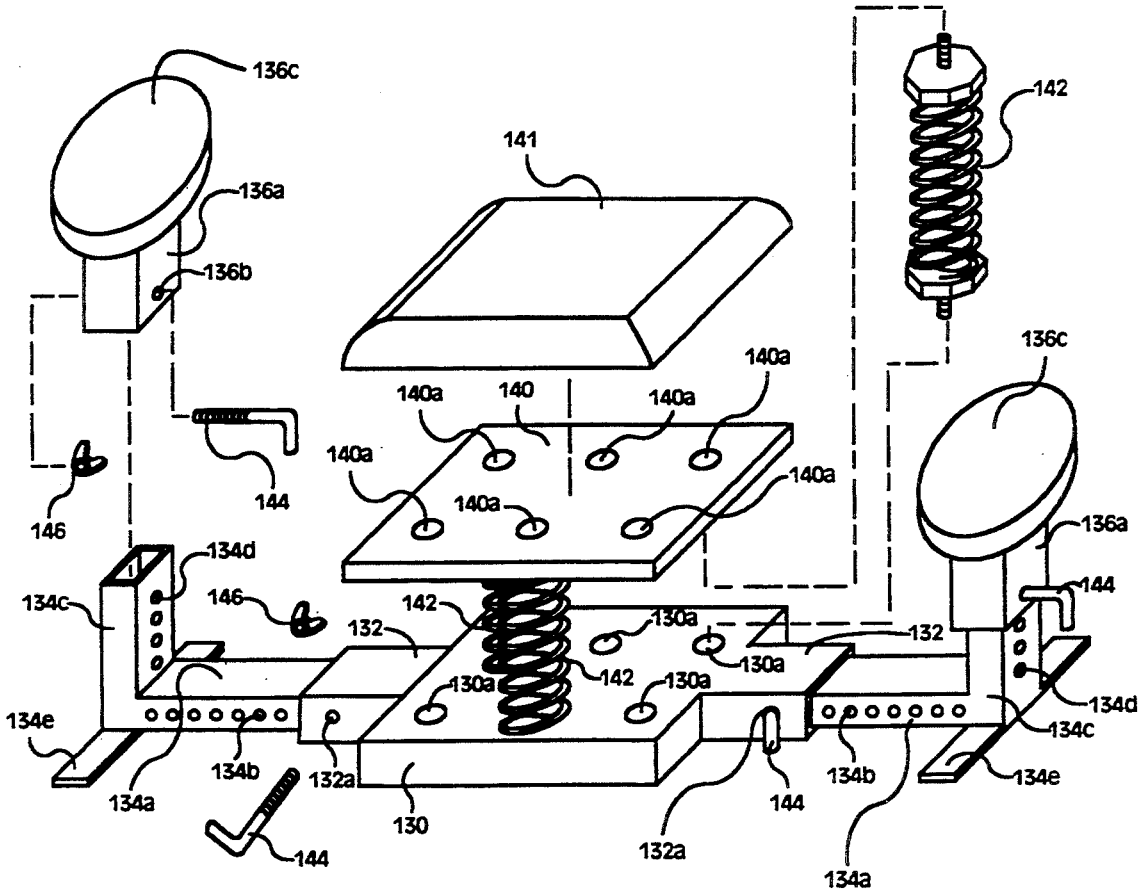
FIG. 11 is an isometric view of the sixth preferred embodiment as it appears at the beginning of the exercise stroke.

The sixth preferred embodiment is shown in FIG. 11. Like reference numbers refer to like parts throughout FIG. 11.

The sixth preferred embodiment is comprised of:

1. A hollow lower metal box 130, approximately ten inches long, seven inches wide and one and one-half inches high. There are six evenly spaced threaded holes 130*a* in double rows in the upper face of said lower metal box 130.
2. Two pieces of one and one-half inch square tubing 132, each approximately three inches long, with one hole 132*a* each in the front and back faces of the square tubing 132.
3. Two pieces of L-shaped one inch square tubing 134, each having:
   (a) an eight-inch horizontal portion 134*a* with eight evenly spaced holes 134*b* in the front and back faces of said horizontal portion 134*a;*
   (b) a three-inch high vertical portion 134*c* with four evenly spaced holes 134*d* in the front and back faces of said vertical portion 134*c; and*
   (c) a flat plate 134*e* welded to the bottom of horizontal portion 134*a*.
4. Two upper portions 136 each comprised of:
   (a) a three-inch long vertical piece of one and one-half inch square tubing 136*a*, with one hole 136*b* each in the front and back faces of said vertical portion 136*a*; and
   (b) a seven-inch long and five-inch wide oval metal handplate 136*c* welded horizontally to the top of said vertical portion 136*a*.
5. An upper metal plate 140, approximately ten inches long and seven inches wide with six evenly spaced threaded holes 140*a* in double rows in the lower face of said upper metal plate 140.
6. One and one-quarter inch thick padding 141 attached to the upper surface of said upper metal plate 140.
7. A number of compression springs 142, each having threaded cylindrical ends of the same threading and bore as said holes 130*a* and 140, respectively, and in pairs having the same strength but each pair being of different strength from the other pairs of springs.
8. Four bolts 144 of the same diameter as said holes 132*a*, 134*b*, 134*d*, and 136*b* in said square tubing 132, L-shaped tubing 134, and upper portions 136, respectively.
9. Four wing nuts 146 of the same threading and bore as said bolts 144.

In use, the two horizontal portions 134*a* of the two L-shaped tubings 134 are slid into the two square tubings 132 until the vertical portions 134*c* are the same distance apart as the exerciser desires to place his hands while doing pushups. The bolts 144 are then slid through the holes 132*a* and 143*b* and secured with the wingnuts 146.

The vertical portions 136*a* of the two upper portions 136 are then slid over the vertical portions 134*c* of the two L-shaped pieces 134 until the metal hand plates 136*c* are at the desired height. The vertical location of the metal handplates 136*c* is then secured by putting the bolts 144 through the holes 136*b* and 134*d* in the vertical portions 136*a* and 134*c* of the two upper portions 136 and the two L-shaped pieces 134, respectively. The wingnuts 146 are then attached to the ends of the bolts 144.

The desired number of the springs 142 are then selected to give an exerciser the proper amount of assistance. The upper ends of the springs 142 are screwed into the holes 140*a* in the upper metal plate 140 and the lower ends of the springs 142 are screwed into the corresponding holes 130*a* in the lower metal box 130.

The sixth preferred embodiment is then placed on the floor. An exerciser places his hands on the hand plates 136*c*, with his chest above the padding 141 on the upper metal plate 140. The exerciser then proceeds to perform pushups. As the exerciser moves downward, the springs 142 are compressed and generate a resisting upward force. This upward force acts upon the exerciser's body through the padding 141 and the upper metal plate 140, thereby assisting the exerciser in doing the pushups.

If an exerciser is unable to do pushups at all, he can maximize the assistance provided by setting the handplates 136*c* at their lowest level and adding additional springs 142 or replacing the springs 142 with stronger springs. As an exerciser becomes more proficient, he can reduce the assistance by removing one or more springs 142 or replacing springs 142 with weaker springs. He can reduce the portion of the exercise stroke through which assistance is provided by merely raising the handplates 136*c*. The exerciser can also focus on developing different muscles by simply sliding the handplates 136*c* closer or farther apart.

This sixth preferred embodiment can also greatly benefit exercisers who are already proficient at doing pushups. First of all, this sixth preferred embodiment can be used as described in the previous paragraph to allow the exerciser to do additional pushups once he has reached the point where he cannot do any more without assistance. Second, the handplates 136c can be placed in their highest position, so that the exerciser receives assistance only through the weak point, thereby allowing the exerciser to fully exercise the muscles used through the strong point, as well as the weak point. Third, if it is difficult for the exerciser to do pushups with his hands spaced far apart, he can still obtain the benefits of that exercise by adjusting the distance between the handplates 136c, the height of the handplates 136c, and the number and/or strength of the springs 142 so that he receives enough assistance to allow him to do pushups with his hands spaced far apart.

Because this sixth preferred embodiment is very portable when taken apart, the exerciser can bring this sixth preferred embodiment with him almost anywhere and can easily store this sixth preferred embodiment in a closet, cabinet, drawer or car trunk.

SEVENTH PREFERRED EMBODIMENT

Figure 12:
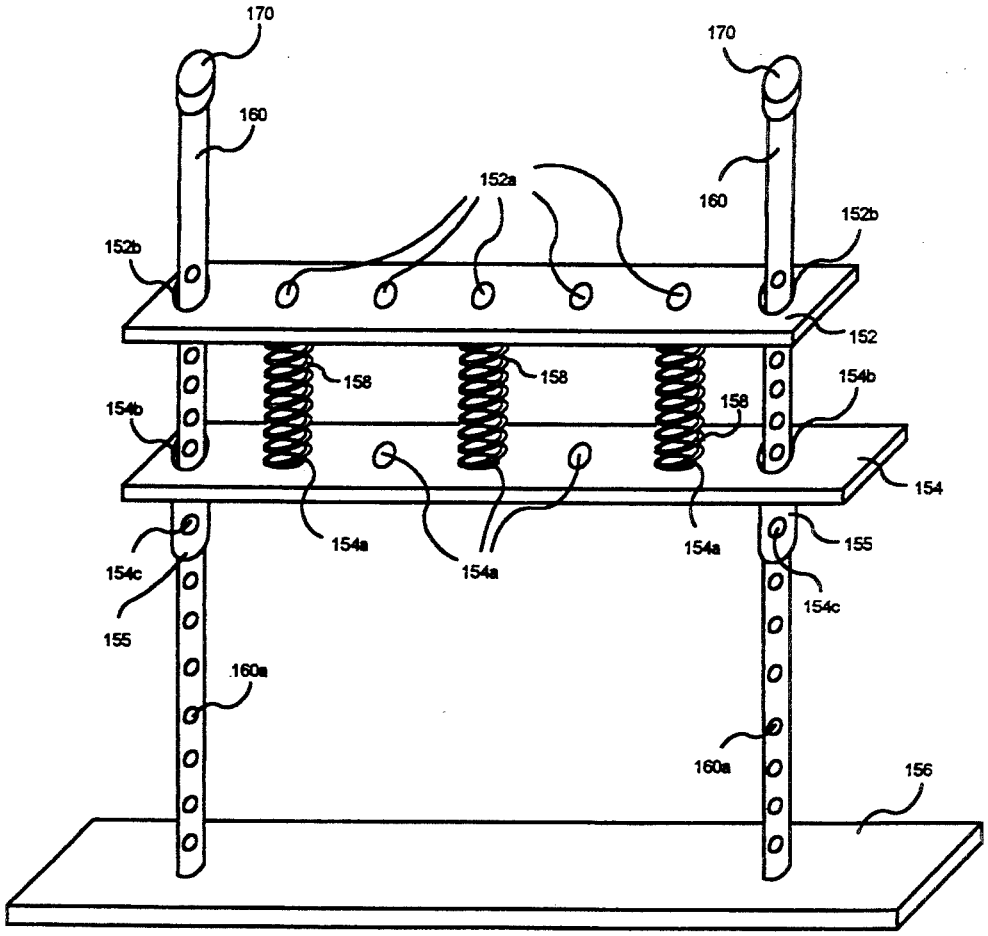
FIG. 12 is an isometric view of the seventh preferred embodiment as it appears at the beginning of the exercise stroke.

The seventh preferred embodiment is shown in FIG. 12. Like reference numbers refer to like parts throughout FIG. 12.

The seventh preferred embodiment is comprised of:

1. An upper surface 152.
2. A middle surface 154.
3. A lower surface 156 of sufficient width to prevent the apparatus from tipping over.
4. Means of creating force, such as the three compression springs 158.
5. Means of connecting the springs 158 between the lower face of upper surface 152 and the upper face of middle surface 154, such as the five vertical-axis threaded holes 152a and the five vertical-axis threaded holes 154a in the upper and middle surfaces 152 and 154a, respectively, into which the ends of springs 158 are screwed.
6. Guideposts 160, the lower ends of which are welded to each end of the lower surface 156 so that they are perpendicular to the upper face of the lower surface 156, and each having fourteen horizontal-axis threaded holes 160a.
7. Two vertical-axis holes 152b and two vertical-axis holes 154b in each end of the upper and middle surfaces 152 and 154, respectively, such holes 152b and 154b having a slightly larger diameter than the guideposts 160.
8. Means of removably attaching the middle surface 154 to the guideposts 160, such as the two set-screws 154c of the same bore at the holes 160a, and the two sleeves 155 each having a same-diameter, horizontal-axis threaded hole 155a, located so that when the set-screws 154c are threaded through the holes 155a, the set-screws 154c enter the holes 160a.
9. Guidepost caps 170, of proper size and shape to fit as caps over the tops of the guideposts 160.

In use, the vertical guideposts 160 are first slid through the holes 154b in the middle surface 154, in such a manner that the sleeves 155 are facing down. The middle surface 154 is then secured at the desired height by inserting the set-screws 154c into the holes 155a in the sleeves 155. Next the guideposts 160 are slid through the holes 152b in the upper surface 152 so that said upper surface 152 can slide up and down said vertical guideposts 160 in a direction generally perpendicular to the upper face of said lower surface 156. The springs 158 are then connected between said middle surface 154 and said upper surface 152, by screwing the top ends of said springs 158 into the threaded holes 152a in the upper surface 152, and by screwing the bottom ends of the springs 158 into the threaded holes 154a in the middle surface 154. The desired height is the height at which the ends of the free-weight barbell will come into contact with the upper surface 152 during the weakpoint, but not during the strongpoint of the exercise stroke.

Another identical apparatus is set up in the same way and placed a few feet away from and parallel to the other seventh preferred embodiment. The exerciser positions himself between the two apparatus. The weightlifter then begins the exercise stroke. During the first portion of the exercise stroke the weight bar is above the upper surfaces 152 and therefore the weightlifter is not assisted by the apparatus. As the weight bar is further lowered, it comes into contact with the upper surfaces 152, which are forced downward. As the upper surfaces 152 move downward, the compression springs 158 are compressed and exert an upward force on the upper surfaces 152, which, in turn, exert an upward force on the weight bar through that lower portion of the exercise stroke.

The amount of assistance provided by the apparatus is adjusted simply by attaching additional springs 158, by removing some of the springs 158, or by replacing the springs 158 with different strength springs. In the version shown in FIG. 12, this is accomplished by simply unscrewing the springs 158 and screwing the upper and lower ends of additional or different strength springs into said threaded holes 152a and 154a, respectively. As exercisers move from exercise to exercise, the height of the apparatus can be adjusted so that it provides assistance only through the weak point of the relevant exercise stroke, by simply raising or lowering the apparatus and reinserting the set-screws 154c to raise or lower the middle surface 154 to the desired height.

EIGHTH PREFERRED EMBODIMENT

The eighth preferred embodiment is a device for use with free-weight exercise, like the seventh preferred embodiment except that it attaches to a support structure instead of being free-standing.

Figure 13:
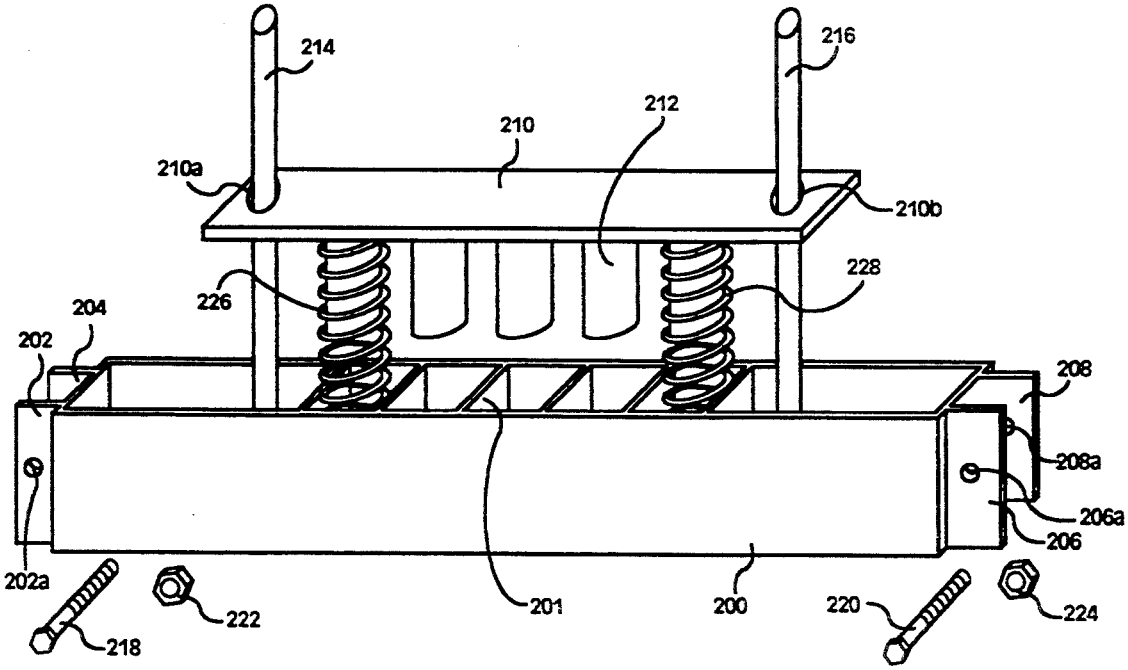
FIG. 13 is an isometric view of the eighth preferred embodiment as it appears at the beginning of the exercise stroke.

The eighth preferred embodiment is shown in FIG. 13. Like reference numbers refer to like parts throughout FIG. 13.

The eighth preferred embodiment is comprised of:

1. A lower metal box 200, made of one-quarter inch thick metal. The lower metal box 200 is thirty-six inches long, three and one-half inches wide, and five inches high. The lower metal box 200 has a front, back, sides, and bottom but no top.
2. Means of removably and adjustably connecting said lower metal box 200 to a support structure, such as the left endplates 202 and 204, connected at right angles to the left face of the lower metal box 200 and having horizontal-axis holes 202a and 204a, respectively, and the right endplates 206 and 208, connected at right angles to the right face of the lower metal box 200 and having horizontal-axis holes 206a and 208a, respectively. The holes 202a, 204a, 206a, and 208a have the same bore as the holes on the vertical beams of whatever support structure the user is plans to use.

3. Means of securing the endplates 202, 204, 206, and 208 to a support structure, such as left and right bolts 218 and 220, respectively, and left and right nuts 222 and 224, respectively. The left and right bolts 218 and 220 are threaded and have the same bore as the holes 202*a*, 204*a*, 206*a*, and 208*a*, and are three inches long. The nuts 222 and 224 have the same bore and threading as the left and right bolts 218 and 220, respectively.
4. An upper surface 210. The upper surface 210 is made of one-quarter inch thick metal and is twenty-two and one-half inches long and three inches wide. The upper surface 210 has a left vertical hole 210*a* passing through the upper surface 210 and centered along a vertical axis located one and one-half inches from the left edge of the upper surface 210 and one and one-half inches from the front edge of the upper surface 210. The upper surface 210 has a right vertical hole 210*b* passing through the upper surface 210 and centered along a vertical axis located one and one-half inches from the right edge of the upper surface 210 and one and one-half inches from the front edge of the upper surface 210. Both holes 210*a* and 210*b* have a circular cross-section with a one and one-thirty-second inch diameter.
5. Means of generating force, such as the two compression springs 226 and 228. The springs 226 and 228 are twelve inches high and have a three-inch outer diameter and at least a two and one-half inch inner diameter.
6. Means of removably connecting the lower ends of the springs 226 and 228 to the lower metal box 200, such as the five square cross-section lower spring supports 201. The lower spring supports 201 are formed by six pieces of one-quarter inch thick, five-inch high, and three-inch wide metal being connected to the front and back of the lower metal box 200, to form five vertical square-cross-section slots, each three inches long and three inches wide. The middle lower spring support 201 is located exactly in the center of the lower plate of the lower metal box 200, and the other lower spring supports 201 are located two on each side of the middle lower spring support 201.
7. Means of removably connecting the upper ends of the springs 226 and 228 to said upper surface 210, such as the five cylinders 212. Each of the five cylinders 212 is five inches high and has a two and one-half inch diameter. The cylinders 212 are attached to the bottom face of the upper surface 210, facing down. The vertical axis of the middle cylinder 212 is located at the exact center of the bottom face of the upper surface 210. The vertical axes of the other cylinders 212 are located two on each side of the middle cylinder 212, along a line running through the width-wise center of the upper surface 210 and three and one-eighths inches apart, so that the vertical axis of each cylinder 212 runs through the center of its corresponding slot 201.
8. Means of restricting the motion of said upper surface 210 to a generally vertical plane, such as the left and right vertical guides 214 and 216. The left and right vertical guides 214 and 216 are each sixteen inches high with a one inch diameter. The left and right vertical guides 214 and 216 are rigidly attached to the upper face of the lower plate of the lower metal box 200. The vertical axes of the left and right vertical guides 214 and 216 are located seven and one-quarter inches from the left and right edges, respectively, of the lower metal, box 200 and along a line passing through the middle of the left and right edges of the lower metal box 200.

In use, the lower metal box 200 is lifted to the desired height and the bolts 218 and 220 are passed through the holes 202*a*, 204*a*, 206*a*, and 208*a*, to connect the lower metal box 200 to a support structure. The lower metal box 200 is then secured by placing the nuts 222 and 224 onto the ends of the bolts 218 and 220, respectively. The desired height is the height at which the free weights will come into contact with the upper surface 210 during the weakpoint, but not during the strongpoint of the exercise stroke.

The lower ends of the springs 226 and 228 are slid into two of the slots 201. The upper surface 210 is then placed over the vertical guides 214 and 216 with the cylinders 212 facing down. The left and right vertical guides 214 and 216 are then slid through the left and right holes 210*a* and 210*b*, respectively, so that said upper surface 210 can slide up and down said left and right vertical guides 214 and 216 in a direction generally perpendicular to the upper said face of said lower metal box 200. The upper ends of the springs 226 and 228 are then slid over the corresponding cylinders 212.

Another identical apparatus is connected at the same height to the opposite side of the support structure, and the exerciser positions himself between the two apparatus. The weightlifter then begins the exercise stroke. During the first portion of the exercise stroke the weight bar is above the upper surfaces 210 and therefore the weightlifter is not assisted by the apparatus. As the weight bar is further lowered, it comes into contact with the upper surfaces 210, which are forced downward. As the upper surfaces 210 move downward, the springs 226 and 228 are compressed and exert an upward force on the upper surfaces 210, which, in turn, exert an upward force on the weight bar through that lower portion of the exercise stroke.

The amount of assistance provided by the eighth preferred embodiment is adjusted simply by attaching additional springs, removing one of the springs 226 and 228, or by replacing the springs 226 and 228 with different strength springs. In the version shown in FIG. 13, this is accomplished by simply lifting up the upper surface 210. As exercisers move from exercise to exercise, the height of the apparatus can be adjusted so that it provides assistance only through the weak point of the relevant exercise stroke, by simply raising or lowering the lower metal box 200 and reinserting the bolts 2 18 and 220 through the holes 202*a*, 204*a*, 206*a*, and 208*a* to raise or lower the lower metal box 200 to the desired height.

NINTH PREFERRED EMBODIMENT

Figure 14:
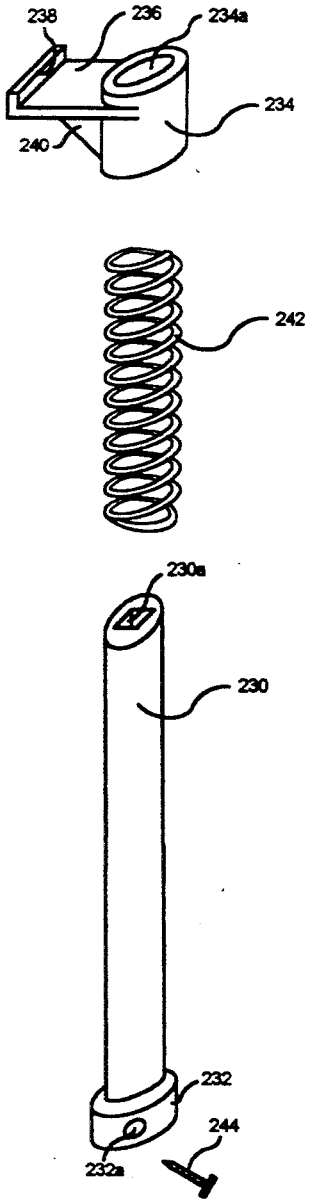
FIG. 14 is an isometric view of the ninth preferred embodiment.

The ninth preferred embodiment is a portable device for use with free-weight exercise. The ninth preferred embodiment is shown in FIG. 14. Like reference numbers refer to like parts throughout FIG. 14.

The ninth preferred embodiment is comprised of:

1. A metal cylindrical sleeve 230, approximately eighteen inches high and having a three and one-eighth inch outer diameter. The metal sleeve 230 has a square cross-section hole 230*a* running through it, centered along the vertical axis of the metal sleeve 230. The hole 230*a* has a cross-section two and one-sixteenth inches long and two and one-sixteenth inches wide.

2. A lower surface, such as lower hollow cylindrical collar 232. The lower collar 232 is one inch high, has a four-inch outer diameter, and has a three and one-eighth inch inner diameter. The lower collar 232 is permanently attached to the bottom of the metal sleeve 230, so that the bottoms of the lower collar 232 and the metal sleeve 230 are lined up at the same height. The lower collar 232 and the metal sleeve 230 have a one-quarter inch diameter threaded screw hole **232*a* passing horizontally through them, located three-eighths of an inch up from the bottoms of the lower collar 232 and the metal sleeve 230**.
3. An upper hollow cylindrical metal collar 234. The upper collar 234 is four inches high, has a four-inch outer diameter, and has a three and five-thirty-seconds inch inner diameter **234*a*. The inner surface 234*a* of the upper collar is of proper configuration to slide smoothly up and down the exterior of the metal sleeve 230**.
4. A weight-bar receiving surface 236. The weight-bar receiving surface 236 is made of one-half inch thick metal, and is approximately four inches long and four inches wide. The weight-bar receiving surface 236 has a one-half inch high lip 238 running along its left edge. The right edge of the weight-bar receiving surface 236 is attached to the left edge of the upper collar 234, approximately one-half inch below the top of the upper collar 234. The weight-bar receiving surface 236 is further supported by a triangular shaped vertical support 240, attached to the bottom of the weight-bar receiving surface 236 and to the left side of upper collar 234. The vertical support 240 is made of one-quarter inch thick metal.
5. A cylindrical compression spring 242, approximately twelve inches high and having an inner diameter just slightly greater than the outer diameter of the metal sleeve 230, so that the spring 242 slides smoothly over the metal sleeve 230.
6. An assortment of springs having dimensions approximately identical to the dimensions of the spring 242, but each being of a different pre-determined strength, ranging in ten pound increments from forty to one hundred and fifty pounds.
7. A screw 244, approximately one and one-half inches long, and having the same bore and threading as the hole **232*a*. The screw 244 has a head that is approximately rectangular in shape and is of sufficient size to allow the screw 244** to be tightened and loosened by hand.

In use, the metal sleeve 230 is slid over vertical two-inch square tubing on any support structure, such as the vertical supports on a standard squat cage. The screw 244 is then inserted through the hole **232*a* to secure the lower collar 232 and the metal sleeve 230 at the desired height. The spring 242 of the desired strength is then slid over the metal sleeve 230, and then the upper collar 234 is slid over the metal sleeve 230, on top of the spring 242. The weight-bar receiving surface 236 is then oriented so that it is facing in a direction perpendicular to the direction the axis of the free-weight bar will be pointed during the exercise stroke. The orientation of the weight-bar receiving surface 236 can be maintained more securely by means of a narrow channel running vertically along the outside of the metal sleeve 230, and a corresponding ridge running vertically along the inside surface 234*a* of the upper collar 234. The desired height is the height at which the free-weight bar will come into contact with the upper surface of said weight-bar receiving surface 236** during the weakpoint, but not during the strongpoint of the exercise stroke.

Another identical ninth preferred embodiment is connected at the same height to the opposite side of the support structure, and the exerciser positions himself between the two devices. The exerciser then begins the exercise stroke. During the first portion of the exercise stroke the weight bar is above the weight-bar receiving surfaces 236 and therefore the weightlifter is not assisted by the apparatus. As the weight bar is further lowered, it comes into contact with the weight-bar receiving surfaces 236, which are forced downward. As the weight-bar receiving surfaces 236 move downward, the spring 242 is compressed and exerts an upward force on the weight-bar receiving surfaces 236, which, in turn, exert an upward force on the free-weight bar through that lower portion of the exercise stroke.

The amount of assistance provided by the device is adjusted by simply replacing the spring 242 with a different strength spring. This is accomplished by simply lifting the upper collar 234 off of the metal sleeve 230, lifting the spring 242 off of the metal sleeve 230, sliding a different spring over the metal sleeve 230, and then sliding the upper collar 234 back over the metal sleeve 230, on top of the new spring. As exercisers move from exercise to exercise, the height of the device can be adjusted so that it provides assistance only through the weak point of the relevant exercise stroke, by simply loosening the screw 244, raising or lowering the device, and reinserting the screw 244 through the hole **232*a*** to secure said the device at the desired height.

TENTH PREFERRED EMBODIMENT

Figure 15:
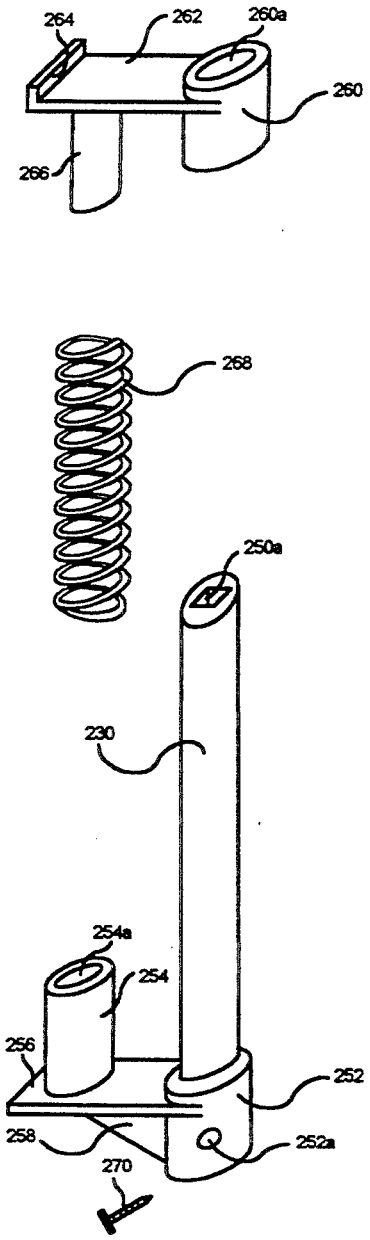
FIG. 15 is an isometric view of the tenth preferred embodiment.

The tenth preferred embodiment is like the ninth preferred embodiment except that it does not have to be removed from the support structure in order to change springs. The tenth preferred embodiment is shown in FIG. 15. Like reference numbers refer to like parts throughout FIG. 15.

The tenth preferred embodiment is comprised of:

1. A metal cylindrical sleeve 250, approximately twenty-two inches high and having a three and one-eighth inch outer diameter. The metal sleeve 250 has a square cross-section hole **250*a* running through it, centered along the vertical axis of the metal sleeve 250. The hole 250*a*** has a cross-section two and one-sixteenth inches long and two and one-sixteenth inches wide.
2. A lower surface, such as lower hollow cylindrical collar 252. The lower collar 252 is five inches high, has a four-inch outer diameter, and has a three and one-eighth inch inner diameter. The lower collar 252 is permanently attached to the bottom of the metal sleeve 250, so that the bottoms of the lower collar 252 and the metal sleeve 250 are lined up at the same height. The lower collar 252 and the metal sleeve 250 have a one-quarter inch diameter threaded screw hole 252a passing horizontally through them, located three-eighths of an inch up from the bottoms of the lower collar 252 and the metal sleeve 250.
3. A lower spring support surface 256. The lower spring support surface 256 is made of one-half inch thick metal, and is approximately seven inches long and four inches wide. The right edge of the lower spring support surface 256 is attached to the left edge of the lower collar 252, approximately one-half inch below the top of the lower collar 252. The lower spring support surface 256 is further supported by a triangular shaped vertical support 258, attached to the bottom of the lower spring support surface 256 and to the left side of lower collar 252. The vertical support 258 is made of one-quarter inch thick metal.

4. A lower spring support 254. The lower spring support 254 is a hollow metal cylinder, five inches high, made of one-quarter inch thick metal, having an inner diameter 254*a* of three and three-fourths inches, and attached perpendicularly to the left edge of the upper face of the lower spring support surface 256, facing down.
5. An upper hollow cylindrical metal collar 260. The upper collar 260 is three inches high, has a four-inch outer diameter, and has a three and five-thirty-seconds inch inner diameter 260*a*. The inner surface 260*a* of the upper collar is of proper configuration to slide smoothly up and down the exterior of the metal sleeve 250.
6. A weight-bar receiving surface 262. The weight-bar receiving surface 262 is made of one-half inch thick metal, and is approximately seven inches long and four inches wide. The weight-bar receiving surface 262 has a one-half inch high lip 264 running along its left edge. The right edge of the weight-bar receiving surface 262 is attached to the left edge of the upper collar 260, approximately one-half inch below the top of the upper collar 260. The weight-bar receiving surface 262 is further supported by a triangular shaped vertical support 258, attached to the bottom of the weight-bar receiving surface 262 and to the left side of upper collar 260. The vertical support 258 is made of one-quarter inch thick metal.
7. An upper spring support 266. The upper spring support 266 is a metal cylinder, five inches high, made of one-quarter inch thick metal, having an outer diameter of three inches, and attached perpendicularly to the left edge of the lower face of the upper spring support surface 262, facing down.
5. A cylindrical compression spring 268, approximately twelve inches high, having an inner diameter that allows the spring 268 easily to slide over the upper spring support 266, and having an outer diameter that allows the spring 268 easily to fit into the lower spring support 254.
6. An assortment of springs having dimensions approximately identical to the dimensions of the spring 268, but each being of a different pre-determined strength, ranging in ten pound increments from forty to one hundred and fifty pounds.
7. A screw 270, approximately one and one-half inches long, and having the same bore and threading as the hole 252*a*. The screw 270 has a head that is approximately rectangular in shape and is of sufficient size to allow the screw 270 to be tightened and loosened by hand.

In use, the metal sleeve 250 is slid over vertical two-inch square tubing on any support structure, such as the vertical supports in a standard squat cage. The screw 270 is then inserted through the hole 252*a* to secure the lower collar 252 and the metal sleeve at the desired height. The upper collar 260 is slid over the metal sleeve 250. The bottom of the spring 268 is then slid into the lower spring support 254 and the top of the spring 268 is slid over the upper spring support 266. The weight-bar receiving surface 262 is then oriented so that it is facing in a direction perpendicular to the direction the axis of the free-weight bar will be pointed during the exercise stroke. The orientation of the weight-bar receiving surface 262 can be maintained more securely by means of a narrow channel running vertically along the outside of the metal sleeve 250, and a corresponding ridge running vertically along the inside surface of the upper collar 260. The desired height is the height at which the free-weight bar will come into contact with the upper surface of said weight-bar receiving surface 262 during the weakpoint, but not during the strong-point of the exercise stroke.

Another identical tenth preferred embodiment is connected at the same height to the opposite side of the support structure, and the exerciser positions himself between the two devices. The exerciser then begins the exercise stroke. During the first portion of the exercise stroke the weight bar is above the weight-bar receiving surfaces 262 and therefore the weightlifter is not assisted by the apparatus. As the weight bar is further lowered, it comes into contact with the weight-bar receiving surfaces 262, which are forced downward. As the weight-bar receiving surfaces 262 move downward, the spring 268 is compressed and exerts an upward force on the weight-bar receiving surfaces 262, which, in turn, exert an upward force on the free-weight bar through that lower portion of the exercise stroke.

The amount of assistance provided by the device is adjusted simply by replacing the spring 268 with a different strength spring. This is accomplished by simply lifting the upper collar 260 up, sliding the spring 268 off of the upper spring support 266 and out of the lower spring support 254, and sliding a different spring over the upper spring support 266 and into the lower spring support 254. As exercisers move from exercise to exercise, the height of the device can be adjusted so that it provides assistance only through the weak point of the relevant exercise stroke, by simply loosening the screw 270, raising or lowering the device, and reinserting the screw 270 through the hole 252*a* to secure said the device at the desired height.

ELEVENTH PREFERRED EMBODIMENT

Figure 16:
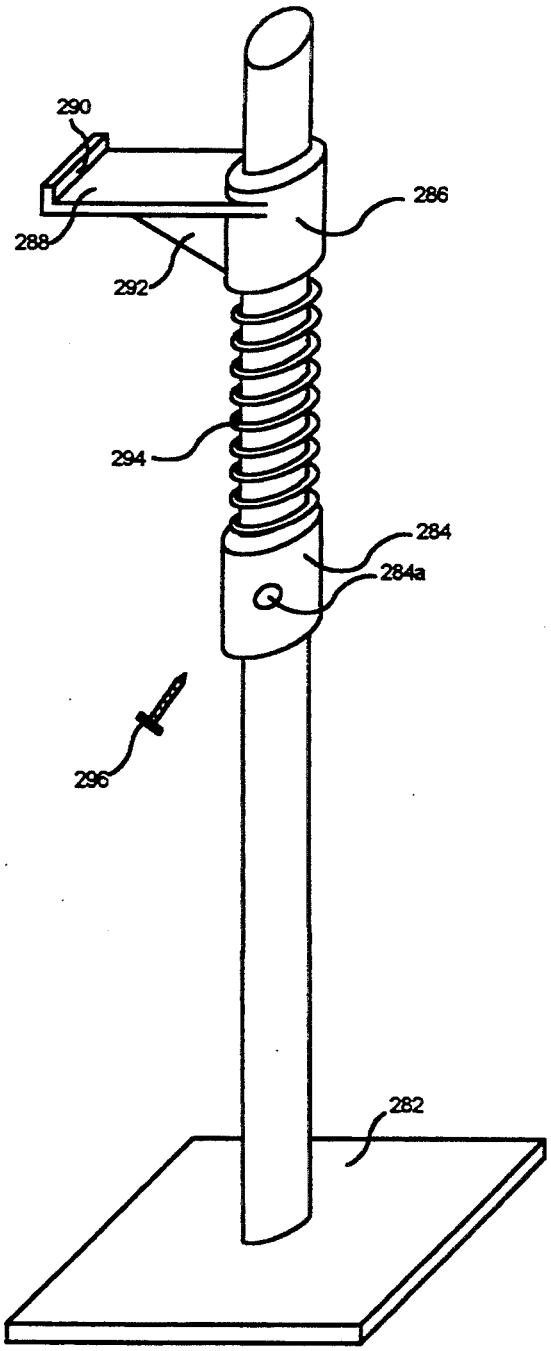
FIG. 16 is an isometric view of the eleventh preferred embodiment.

The eleventh preferred embodiment is like the ninth preferred embodiment except that it is free-standing instead of being attached to a support structure. The eleventh preferred embodiment is shown in FIG. 16. Like reference numbers refer to like parts throughout FIG. 16.

The eleventh preferred embodiment is comprised of:

1. A metal support plate 282, in the shape of a rectangular hexahedron, one inch high, twelve inches long, and nine inches wide.
2. A metal cylindrical post 280, approximately sixty inches high and having a three inch outer diameter. The cylindrical post 280 is rigidly and perpendicularly attached to the center of the upper face of the support plate 282.
2. A lower surface, such as lower hollow cylindrical collar 284. The lower collar 284 is one inch high, has a four-inch outer diameter, and has a three and one-thirty-second inch inner diameter. The lower collar 284 has a one-quarter inch diameter threaded screw hole 284*a* passing horizontally through it, located three-eighths of an inch up from the bottom of the lower collar.

3. An upper hollow cylindrical metal collar 286. The upper collar 286 is four inches high, has a four-inch outer diameter, and has a three and one-thirty-seconds inch inner diameter 286*a*.
4. A weight-bar receiving surface 288. The weight-bar receiving surface 288 is made of one-half inch thick metal, and is approximately seven inches long and four inches wide. The weight-bar receiving surface 288 has a one-half inch high lip 290 running along its left edge. The right edge of the weight-bar receiving surface 288 is attached to the left edge of the upper collar 286, approximately one-half inch below the top of the upper collar 286. The weight-bar receiving surface 288 is further supported by a triangular shaped vertical support 292, attached to the bottom of the weight-bar receiving surface 288 and to the left side of upper collar 286. The vertical support 292 is made of one-quarter inch thick metal.
5. A cylindrical compression spring 294, approximately twelve inches high and having an inner diameter just slightly greater than the outer diameter of the cylindrical post 280, so that the spring 294 slides smoothly over the cylindrical post 280.
6. An assortment of springs having dimensions approximately identical to the dimensions of the spring 294, but each being of a different pre-determined strength, ranging in ten pound increments from forty to one hundred and fifty pounds.
7. A screw 296, approximately one and one-half inches long, and having the same bore and threading as the hole 284*a*. The screw 296 has a head that is approximately rectangular in shape and is of sufficient size to allow the screw 296 to be tightened and loosened by hand.

In use, the lower collar 284 is slid over the cylindrical post 280, and is moved to the desired height. The screw 296 is then inserted through the hole 284*a* to secure the lower collar 284 to the cylindrical post 280 at the desired height. The desired height is the height at which the free-weight bar will come into contact with the upper surface of said weight-bar receiving surface 288 during the weakpoint, but not during the strongpoint of the exercise stroke.

The spring 294 of the desired strength is then slid over the cylindrical post 280, and then the upper collar 286 is slid over the cylindrical post 280, on top of the spring 294. The weight-bar receiving surface 288 is then oriented so that it is facing in a direction perpendicular to the direction the axis of the free-weight bar will be pointed during the exercise stroke. The orientation of the weight-bar receiving surface 288 can be maintained more securely by means of a narrow channel running vertically along the outside of the cylindrical post 280, and a corresponding ridge running vertically along the inside surface of the upper collar 286.

Another identical eleventh preferred embodiment is set up in the same manner, and the exerciser positions himself between the two devices. The exerciser then begins the exercise stroke. During the first portion of the exercise stroke the weight bar is above the weight-bar receiving surfaces 288 and therefore the weightlifter is not assisted by the apparatus. As the weight bar is further lowered, it comes into contact with the weight-bar receiving surfaces 288, which are forced downward. As the weight-bar receiving surfaces 288 move downward, the spring 294 is compressed and exerts an upward force on the weight-bar receiving surfaces 288, which, in turn, exert an upward force on the free-weight bar through that lower portion of the exercise stroke.

The amount of assistance provided by the device is adjusted simply by replacing the spring 294 with a different strength spring. This is accomplished by simply lifting the upper collar 286 off of the cylindrical post 280, lifting the spring 294 off of the cylindrical post 280, sliding a different spring over the cylindrical post 280, and then sliding the upper collar 286 back over the cylindrical post 280, on top of the new spring. As exercisers move from exercise to exercise, the height of the device can be adjusted so that it provides assistance only through the weak point of the relevant exercise stroke, by simply loosening the screw 296, raising or lowering the lower collar 284, and reinserting the screw 296 through the hole 284*a* to secure the lower collar 284 at the desired height.

I claim:

1. A portable assisted-pushup exercise device comprising:

a support means for stably supporting the device on a level surface, the support means including a lower generally horizontal support;

an upper generally horizontal support above the lower support for supporting the exerciser's chest;

a pair of extension arms attached to and extending outwardly from the lower support to opposite sides of the lower support;

a pair of hand supports for statically supporting the exerciser's hands attached respectively to the extension arms and horizontally spaced from each other along a line intersecting a generally vertical projection of the upper and lower supports;

biasing means secured between the upper and lower supports for resisting movement of the upper support generally vertically toward the lower support to a lower position and assisting movement of the upper support generally vertically away from the lower support to an upper position;

the hand supports being below the top surface of the upper support when the upper support is at the upper position and spaced horizontally from the upper support so that an exerciser may perform assisted pushups with the chest contacting the upper support, the hands supported by the hand supports, and the feet on the level surface.

2. The portable assisted-pushup exercise device of claim 1 wherein the extension arms are hinged to the lower support.

3. The portable assisted-pushup exercise device of claim 1 further comprising a detachment means for detachably securing the biasing means between the upper and lower supports.

4. The portable assisted-pushup exercise device of claim 1 wherein the biasing means comprises a spring.

5. The portable assisted-pushup exercise device of claim 4 wherein the upper and lower supports each include a cylinder, and the spring surrounds one of the cylinders and is surrounded by the other.

6. The portable assisted-pushup exercise device of claim 1 further comprising horizontal adjustment means allowing adjustment of the distance between the hand supports along the horizontal line.

7. The portable assisted-pushup exercise device of claim 6 wherein the extension arms are slidably attached to the lower support thereby allowing adjustment of the distance between the hand supports along the horizontal line.

8. The portable assisted-pushup exercise device of claim 7 wherein the lower support surface comprises a hollow portion and the extension arms are slidable into the hollow portion.

9. The portable assisted-pushup exercise device of claim 1 further comprising vertical adjustment means allowing adjustment of the vertical distance between the hand supports and the lower surface of the lower support.

10. The portable assisted-pushup exercise device of claim 1 wherein the hand supports comprise handles for grasping by the exerciser.

11. The portable assisted-pushup exercise device of claim 1 wherein the extension arms comprise bars having graspable portions for grasping by the exerciser.

12. The portable assisted-pushup exercise device of claim 1 further comprising arm detachment means for detachably attaching the extension arms to the lower support.

* * * * *